US011473830B2

(12) United States Patent
Roslindo et al.

(10) Patent No.: US 11,473,830 B2
(45) Date of Patent: Oct. 18, 2022

(54) ADAPTIVE DEFROST ACTIVATION METHOD

(71) Applicant: Electrolux do Brasil S.A., Curitiba (BR)

(72) Inventors: Rafael Roslindo, Curitiba (BR); Felipe Ormelez, Curitiba (BR); Israel Mercer, Curitiba (BR); Rafael Leidens, Curitiba (BR); Alcione Colecha, Curitiba (BR); Antonio Voltarelli, Curitiba (BR); Guilherme Picanço, Curitiba (BR)

(73) Assignee: Electrolux do Brasil S.A., Curitiba (BR)

( * ) Notice: Subject to any disclaimer, the term of this patent is extended or adjusted under 35 U.S.C. 154(b) by 232 days.

(21) Appl. No.: 16/977,993

(22) PCT Filed: Mar. 9, 2018

(86) PCT No.: PCT/BR2018/050063

§ 371 (c)(1),
(2) Date: Sep. 3, 2020

(87) PCT Pub. No.: WO2019/169459

PCT Pub. Date: Sep. 12, 2019

(65) Prior Publication Data

US 2021/0071932 A1 Mar. 11, 2021

(51) Int. Cl.
*F25D 21/00* (2006.01)

(52) U.S. Cl.
CPC ..... *F25D 21/006* (2013.01)

(58) Field of Classification Search
CPC ..... F25D 21/002; F25D 21/02; F25D 21/006; F25D 21/08; F25D 21/008;
(Continued)

(56) References Cited

U.S. PATENT DOCUMENTS 4,646,536 A 3/1987 Yamada et al.
4,750,332 A * 6/1988 Jenski ..... F25D 29/00 62/155

(Continued)

FOREIGN PATENT DOCUMENTS

KR 20100059524 A 6/2010
WO 9513510 A1 5/1995

OTHER PUBLICATIONS

International Search Report and Written Opinion for International Application No. PCT/BR2018/050063, dated Nov. 26, 2018, 10 pages.

*Primary Examiner* — Nelson J Nieves
*Assistant Examiner* — Meraj A Shaikh
(74) *Attorney, Agent, or Firm* — Pearne & Gordon LLP

(57) ABSTRACT

A method and apparatus for controlling the defrost cycles of evaporators associated with the compartments of a refrigerator. Defrost heaters associated with each evaporator are turned on and run until either a predetermined maximum defrost temperature is reached for the compartments or until a predetermined maximum run time is reached for each defrost heater. A controller determines a defrost interval based on running times of the freezer defrost heater and the ice maker defrost heater so that the duration of the defrost interval is inversely related to the duration of the running time of the freezer defrost heater and the ice maker defrost heater. The controller also reduces the defrost interval for every second a door of the compartments remains open, compares the reduced defrost interval with the defrost length, and selects the shorter one as the new defrost interval.

24 Claims, 15 Drawing Sheets

(58) Field of Classification Search
CPC ..... F25D 2700/12; F25D 2700/121; F25D 2700/122; F25D 2700/123
See application file for complete search history.

(56) References Cited

U.S. PATENT DOCUMENTS

| | | | | |
|---|---|---|---|---|
| 5,816,054 | A | 10/1998 | Yoo et al. | |
| 5,931,004 | A | 8/1999 | Yoo et al. | |
| 6,058,723 | A | 5/2000 | Kusunoki et al. | |
| 6,260,365 | B1 | 7/2001 | Davis et al. | |
| 6,438,978 | B1 * | 8/2002 | Bessler | F25B 41/347 62/223 |
| 6,606,870 | B2 | 8/2003 | Holmes et al. | |
| 6,631,620 | B2 | 10/2003 | Gray et al. | |
| 6,694,754 | B1 | 2/2004 | Schenk et al. | |
| 6,694,755 | B2 | 2/2004 | Collins | |
| 6,739,146 | B1 | 5/2004 | Davis et al. | |
| 6,772,597 | B1 | 8/2004 | Zentner et al. | |
| 6,802,186 | B2 | 10/2004 | Holmes et al. | |
| 6,817,195 | B2 | 11/2004 | Rafalovich et al. | |
| 7,454,918 | B2 | 11/2008 | Davem et al. | |
| 7,614,244 | B2 | 11/2009 | Venkatakrishnan | |
| 7,703,293 | B2 | 4/2010 | An et al. | |
| 7,942,014 | B2 | 5/2011 | Rafalovich et al. | |
| 7,971,444 | B2 | 7/2011 | Malpetti | |
| 8,074,464 | B2 | 12/2011 | Venkatakrishnan | |
| 8,117,853 | B2 | 2/2012 | Schmid | |
| 8,371,136 | B2 | 2/2013 | Venkatakrishnan | |
| 8,484,987 | B2 | 7/2013 | Ducharme et al. | |
| 9,068,771 | B2 | 6/2015 | Shah | |
| 9,109,829 | B2 | 8/2015 | Lim et al. | |
| 9,234,690 | B2 | 1/2016 | McCollough et al. | |
| 9,857,116 | B2 | 1/2018 | Lim et al. | |
| 9,976,788 | B2 | 5/2018 | Bertolini et al. | |
| 10,036,585 | B2 | 7/2018 | McCollough et al. | |
| 2004/0244389 | A1 * | 12/2004 | Denvir | F25D 21/002 62/155 |
| 2005/0223722 | A1 | 10/2005 | Yamashita et al. | |
| 2007/0033956 | A1 * | 2/2007 | Kang | F25D 17/065 62/154 |
| 2008/0178621 | A1 | 7/2008 | Kang | |
| 2009/0090114 | A1 * | 4/2009 | Choo | F25D 21/006 62/208 |
| 2009/0293501 | A1 | 12/2009 | Kulkarni et al. | |
| 2010/0162747 | A1 * | 7/2010 | Hamel | F25D 11/022 62/455 |
| 2014/0053581 | A1 | 2/2014 | Cho et al. | |
| 2015/0027148 | A1 | 1/2015 | Chung et al. | |
| 2015/0168024 | A1 | 6/2015 | Lee et al. | |
| 2017/0030628 | A1 | 2/2017 | Sanders et al. | |
| 2017/0191733 | A1 | 7/2017 | Li | |

* cited by examiner

ADAPTIVE DEFROST ACTIVATION METHOD

CROSS-REFERENCE TO RELATED APPLICATIONS

Not Applicable.

FIELD OF THE INVENTION

This application relates generally to a refrigeration appliance with multiple refrigeration compartments, and more particularly, to an adaptive defrost activation method for simultaneously defrosting multiple evaporators disposed in multiple compartments of a refrigeration appliance.

BACKGROUND OF THE INVENTION

Refrigeration appliances, such as domestic refrigerators, are provided with a cooling/refrigeration system for the purpose of generating and dispersing cold air into the refrigeration cavities. A typical refrigerator includes a freezer compartment that operates at a temperature below freezing and a fresh-food compartment that operates at a temperature between the ambient temperature (that is, the temperature in the space outside the refrigerator cabinet) and freezing. The refrigeration system can include either a standard compressor or a variable speed compressor, a condenser, a condenser fan, an evaporator connected in series and charged with a refrigerant, and an evaporator fan. The evaporator fan circulates cooling air through the refrigerator compartments and improves heat transfer efficiency. Conventional refrigerators use a defrost heater to eliminate frost buildup on the evaporator coils. After defrost, the compressor is typically run for a predetermined time to lower the evaporator temperature. However, opening the doors of the refrigeration compartments frequently or leaving the doors open for an extended period of time introduces warm ambient air and humidity into the refrigeration compartments and interferes with the defrost cycle, thereby reducing the energy efficiency. Therefore, it is desirable to provide a defrost cycle control method that addresses these problems.

BRIEF SUMMARY OF THE INVENTION

In accordance with one aspect, there is provided a refrigeration appliance including a fresh food compartment for storing food items at a first target temperature above zero degrees Celsius, a freezer compartment for storing food items at a second target temperature below zero degrees Celsius, an ice maker disposed within the fresh food compartment for freezing water into ice pieces, a refrigeration circuit having: a compressor, a fresh food evaporator associated with the fresh food compartment, a freezer evaporator associated with the freezer compartment, and an ice maker evaporator associated with the ice maker; a fresh food evaporator fan, a freezer evaporator fan, and an ice maker evaporator fan, each located at the fresh food evaporator, the freezer evaporator, and the ice maker evaporator, respectively; a freezer defrost heater associated with the freezer evaporator and an ice maker defrost heater associated with the ice maker; and a valve connected to selectively direct refrigerant to flow to the fresh food evaporator, the freezer evaporator, and the ice maker evaporator in a first position and direct refrigerant to bypass the fresh food evaporator and flow to the ice maker evaporator and the freezer evaporator in a second position, and a controller operatively connected to the refrigeration circuit. The controller is programmed to control running the fresh food evaporator fan for a predetermined operating time, while the compressor is turned on and the valve is in the second position. The controller is further programmed to start a defrost procedure including turning off the compressor, running the fresh food evaporator fan and the freezer evaporator fan while the freezer defrost heater is turned off. The controller is also programmed to, after the freezer evaporator fan has been running for a predetermined freezer fan defrost time, turn off the freezer evaporator fan, turn on the freezer defrost heater, and run the freezer defrost heater until reaching a predetermined maximum freezer evaporator defrost temperature or until reaching a predetermined maximum run time for the freezer defrost heater. The controller is further programmed to turn on the ice maker defrost heater and run the ice maker defrost heater until reaching a predetermined maximum ice maker evaporator defrost temperature or until reaching a predetermined maximum run time for the freezer defrost heater. The controller is also programmed to turn off the freezer defrost heater and the ice maker defrost heater when reaching the respective predetermined maximum defrost temperature or when reaching the predetermined maximum run time for the freezer defrost heater. The controller is further programmed to end the defrost procedure when both the freezer defrost heater and the ice maker defrost heater are turned off. The controller is also programmed to determine a defrost interval based on running times of the freezer defrost heater and the ice maker defrost heater so that the duration of the defrost interval is inversely related to the duration of the running time of the freezer defrost heater and the ice maker defrost heater. The defrost interval is a time period between an end of a previous defrost cycle and a start of a next defrost cycle.

In the refrigeration appliance according to the foregoing aspect, the controller is further programmed to, if a specified interval since a last defrost procedure has expired and the valve is in an ice maker/freezer position, check a temperature of the fresh food compartment. The controller is also programmed to, if the temperature of the fresh food compartment is equal to or above a user-selected set point temperature, start the defrost procedure for the fresh food evaporator, the freezer evaporator, and the ice maker evaporator. The controller is further programmed to, if the temperature of the fresh food compartment is not equal to or above the user-selected set point temperature, delay a start of the defrost procedure for the fresh food evaporator, the freezer evaporator, and the ice maker evaporator until a specified boost time has expired. The controller is also programmed to, if the valve is in a fresh food compartment position, delay the start of the defrost procedure for the fresh food evaporator, the freezer evaporator, and the ice maker evaporator until the specified boost time has expired.

In the refrigeration appliance according to the foregoing aspect, the predetermined maximum freezer evaporator defrost temperature is sensed by a freezer evaporator temperature sensor and the predetermined maximum ice maker evaporator defrost temperature is sensed by an ice maker evaporator temperature sensor.

In the refrigeration appliance according to the foregoing aspect, the controller is further programmed to end the defrost procedure after maximum predetermined drip times for the freezer evaporator, and the ice maker evaporator, respectively.

In the refrigeration appliance according to the foregoing aspect, after ending the defrost procedure, the controller is further programmed to delay turning on the compressor for maximum predetermined drip times for the freezer evaporator, and the ice maker evaporator, respectively.

In the refrigeration appliance according to the foregoing aspect, the defrost procedure for the fresh food evaporator, the freezer evaporator, and the ice maker evaporator starts at the same time.

The refrigeration appliance of claim 6, wherein the starting of the defrost procedure comprises: turning on the freezer evaporator fan, turning on the fresh food evaporator fan, and turning on the ice maker defrost heater.

In the refrigeration appliance according to the foregoing aspect, the controller is further programmed to compare the heater activation periods of time for the ice maker defrost heater and the freezer defrost heater. The controller is also programmed to select a longer heater activation period of time between the heater activation periods of time for the ice maker defrost heater and the freezer defrost heater; store the longer heater activation period as a defrost length; and calculate a new defrost interval based on the defrost length.

In the refrigeration appliance according to the foregoing aspect, during the defrost procedure, the fresh food evaporator fan and the freezer evaporator fan run simultaneously.

In accordance with another aspect, there is provided a method for controlling defrost cycles of a first evaporator associated with a first refrigeration compartment and a second evaporator associated with a second refrigeration compartment of a refrigerator. The refrigerator is cooled by a refrigeration circuit having a compressor, a first defrost heater associated with the first evaporator, and a second defrost heater associated with the second evaporator. The method includes turning on the first defrost heater and the second defrost heater after a defrost interval has elapsed. The method further includes running the first defrost heater until reaching a predetermined maximum defrost temperature for the first refrigeration compartment or until reaching a predetermined maximum run time for the first defrost heater. The method also includes running the second defrost heater until reaching a predetermined maximum defrost temperature for the second refrigeration compartment or until reaching a predetermined maximum run time for the second defrost heater. The method further includes counting, with a timer, heater activation periods of time during which the first defrost heater and the second defrost heater have been on, comparing the heater activation periods of time for the first defrost heater and the second defrost heater, selecting a longer heater activation period of time between the heater activation periods of time for the first defrost heater and the second defrost heater, storing the longer heater activation period as a defrost length, and calculating a new defrost interval based on the defrost length.

In the method for controlling the defrost cycles of the first evaporator and the second evaporator, the defrost interval is a time period between an end of a previous defrost cycle and a start of a next defrost cycle for each evaporator.

In the method for controlling the defrost cycles of the first evaporator and the second evaporator, the defrost interval is 96 hours.

In the method for controlling the defrost cycles of the first evaporator and the second evaporator, the first refrigeration compartment is a freezer compartment for storing items at a target temperature below zero degrees Celsius.

In the method for controlling the defrost cycles of the first evaporator and the second evaporator, the method further includes comparing a temperature of the first evaporator with a predetermined maximum evaporator temperature. If the temperature of the first evaporator is lower than the predetermined maximum evaporator temperature, the method further includes setting the defrost interval to 30 minutes. If the temperature of the first evaporator is not lower than the predetermined maximum evaporator temperature, the method further includes checking whether the temperature of the first evaporator is lower than 0° C. If the temperature of the first evaporator is lower than 0° C., the method includes setting the defrost interval to 3 hours. If the temperature of at least one evaporator is not lower than 0° C., the method includes setting the defrost interval to 12 hours.

In the method for controlling the defrost cycles of the first evaporator and the second evaporator, the predetermined maximum evaporator temperature is −15° C.

In the method for controlling the defrost cycles of the first evaporator and the second evaporator, the refrigeration circuit further includes a condenser fan, a first evaporator fan, and a second evaporator fan located in a vicinity of the first evaporator and the second evaporator, respectively.

In the method for controlling the defrost cycles of the first evaporator and the second evaporator, the method further includes activating at least one of the first evaporator fan and the second evaporator fan, while the compressor, the condenser fan, and the defrost heaters are all turned off. The method also includes running at least one of the first evaporator fan and the second evaporator fan for a predetermined fan defrost time for each of the first evaporator fan and the second evaporator fan. After at least one of the first evaporator fan and the second evaporator fan has been running for the predetermined time, the method further includes turning at least one of the first evaporator fan and the second evaporator fan off, turning the respective first defrost heater or second defrost heater on, and starting the timer to count the heater activation period of time during which each defrost heater has been on. When either a defrost cut-off temperature in at least one of the first refrigeration compartment and the second refrigeration compartment, or a maximum predetermined heater activation period of time for each defrost heater has been reached, the method includes turning off the respective first defrost heater or second defrost heater, and storing the heater activation period of time for each defrost heater in a memory.

In the method for controlling the defrost cycles of the first evaporator and the second evaporator, the length of the defrost interval is selected from a table of values corresponding to times doors of at least one of the fresh-food compartment and the freezer compartment are opened and durations of time the doors remain open. In the method for controlling the defrost cycles of the first evaporator and the second evaporator, every time at least one of the doors of at least one of the first refrigeration compartment and the second refrigeration compartment is open, the method further includes counting, by a door counter, a time period the respective door remains open. The method also includes reducing the defrost interval for every second the respective door remains open, and storing the reduced defrost interval.

In the method for controlling the defrost cycles of the first evaporator and the second evaporator, the method further includes comparing the defrost length with the reduced defrost interval, and selecting the shorter one of the defrost length and the reduced defrost interval as the new defrost interval.

In accordance with another aspect, there is provided a refrigeration appliance including a first refrigeration compartment, a second refrigeration compartment, a refrigeration circuit having a compressor, a first evaporator associated with the first refrigeration compartment, a second evaporator associated with the second refrigeration compartment, and a first defrost heater associated with the first evaporator and a second defrost heater associated with the second evaporator, and a controller operatively connected to the refrigeration circuit. The controller is programmed to turn on the first defrost heater and the second defrost heater after a defrost interval has elapsed. The controller is further programmed to run the first defrost heater until reaching a predetermined maximum defrost temperature for the first refrigeration compartment or until reaching a predetermined maximum run time for the first defrost heater, run the second defrost heater until reaching a predetermined maximum defrost temperature for the second refrigeration compartment or until reaching a predetermined maximum run time for the second defrost heater, count heater activation periods of time during which the first defrost heater and the second defrost heater have been on, and compare the heater activation periods of time for the first defrost heater and the second defrost heater. The controller is also programmed to select a longer heater activation period of time between the heater activation periods of time for the first defrost heater and the second defrost heater, store the longer heater activation period as a defrost length, and calculate a new defrost interval based on the defrost length.

In the refrigeration appliance according to the foregoing aspect, the controller comprises a timer that counts the predetermined maximum run time for the first defrost heater, the predetermined maximum run time for the second defrost heater, and the heater activation periods of time during which the first defrost heater and the second defrost heater have been on.

In the refrigeration appliance according to the foregoing aspect, there may be provided a plurality of temperature sensors that sense temperatures of the first evaporator and the second evaporator, and generate temperature signals based on the sensed temperatures. The controller may receive the temperature signals from the temperature sensors, determine whether the temperatures of the first evaporator and the second evaporator are lower than a predetermined maximum evaporator temperature for each evaporator, and generate control signals setting the defrost interval based on the determination result.

In the refrigeration appliance according to the foregoing aspect, the defrost interval may be 96 hours and the first refrigeration compartment may be a freezer compartment for storing items at a target temperature below zero degrees Celsius. If the temperature of the first evaporator is lower than the predetermined maximum evaporator temperature for the first evaporator, the controller sets the defrost interval to 30 minutes. If the temperature of the first evaporator is not lower than the predetermined maximum evaporator temperature for the first evaporator, the controller checks whether the temperature of the first evaporator is lower than 0° C. If the temperature of the first evaporator is lower than 0° C., the controller sets the defrost interval to 3 hours. If the temperature of at least one evaporator is not lower than 0° C., the controller sets the defrost interval to 12 hours.

In the refrigeration appliance according to the foregoing aspect, there may be provided a memory that stores program instructions executed by the controller, default defrost intervals, predetermined defrost cut-off temperatures for each of the first refrigeration compartment and the second refrigeration compartment, a maximum time for running each of the first defrost heater and the second defrost heater, the heater activation period of time during which each of the first defrost heater and the second defrost heater has been on, a table of values corresponding to times between openings of doors of the first refrigeration compartment and the second refrigeration compartment, and durations of time the doors remain open.

In the refrigeration appliance according to the foregoing aspect, the refrigeration circuit may further include a condenser fan, a first evaporator fan, and a second evaporator fan located in the vicinity of the first evaporator and the second evaporator, respectively. The controller may be further programmed to activate at least one of the first evaporator fan and the second evaporator fan, while the compressor, the condenser fan, and the defrost heaters are all turned off, and run at least one of the first evaporator fan and the second evaporator fan for a predetermined fan defrost time for each of the first evaporator fan and the second evaporator fan. After at least one of the first evaporator fan and the second evaporator fan has been running for the predetermined time, the controller may be programmed to turn at least one of the first evaporator fan and the second evaporator fan off, turn the respective first defrost heater or second defrost heater on, and start the timer to count the heater activation period of time during which each defrost heater has been on. When either a defrost cut-off temperature in at least one of the first refrigeration compartment and the second refrigeration compartment, or a maximum predetermined heater activation period of time for each defrost heater has been reached, the controller may be further programmed to turn off the respective first defrost heater or second defrost heater, and store the heater activation period of time for each defrost heater in the memory.

In the refrigeration appliance according to the foregoing aspect, the second refrigeration compartment may be an ice-making compartment and the second evaporator may be a remote part of the first evaporator.

In the refrigeration appliance according to the foregoing aspect, the first refrigeration compartment is a freezer compartment for storing items at a target temperature below zero degrees Celsius; and the second refrigeration compartment comprises an ice-making compartment with the second evaporator associated with the ice-making compartment.

DESCRIPTION OF EXAMPLE EMBODIMENTS

Figure 1:
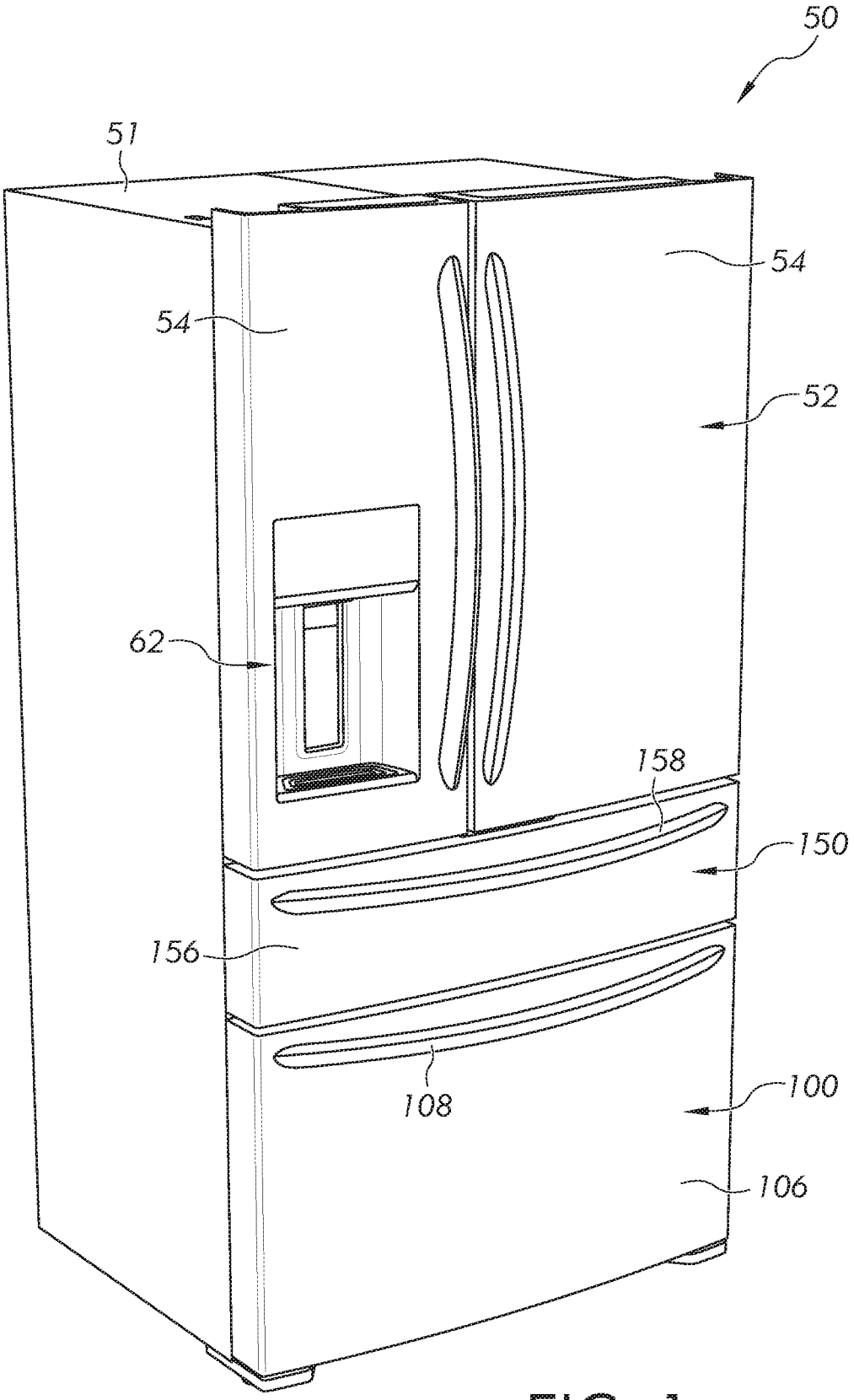
FIG. 1 is a front perspective view of a household French Door Bottom Mount refrigerator showing doors of the refrigerator in a closed position.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Such conventional refrigerators are often provided with a unit for making ice pieces, commonly referred to as "ice cubes" despite the non-cubical shape of many such ice pieces. For refrigerators such as the so-called "bottom mount" refrigerator, which includes a freezer compartment disposed vertically beneath a fresh food compartment, the ice making unit is arranged in the fresh food compartment. Alternatively, the ice making unit may be located in the freezer compartments of the refrigerators and manufacture ice by convection, i.e., by circulating cold air over water in an ice tray to freeze the water into ice cubes. Storage bins for storing the frozen ice pieces may be provided adjacent to the ice making units. The ice pieces can be dispensed from the storage bins through a dispensing port in the door that closes the fresh food compartment or the freezer to the ambient air. The dispensing of the ice usually occurs by means of an ice delivery mechanism that extends between the storage bin and the dispensing port in the respective compartment door.

Referring now to the drawings, FIG. 1 shows a refrigeration appliance in the form of a domestic refrigerator, indicated generally at 50. Although the detailed description that follows concerns a domestic refrigerator 50, the invention can be embodied by refrigeration appliances other than with a domestic refrigerator 50. Further, an embodiment is described in detail below, and shown in the figures as a bottom-mount configuration of a refrigerator 50, including a fresh food compartment 52 disposed vertically above a variable climate zone (VCZ) compartment 150 and a freezer compartment 100. However, the refrigerator 50 can have any desired configuration including at least a fresh food compartment 52 and/or a freezer compartment 100, such as a top mount refrigerator (freezer disposed above the fresh food compartment), a side-by-side refrigerator (fresh food compartment is laterally next to the freezer compartment), a standalone refrigerator or freezer, etc.

Two doors 54 shown in FIG. 1 are pivotally coupled to a cabinet 51 of the refrigerator 50 to restrict and grant access to the fresh food compartment 52. The doors 54 are French-type doors that collectively span the entire lateral distance of the entrance to the fresh food compartment 52 to enclose the fresh food compartment 52. A center flip mullion 58 (FIG. 2) is pivotally coupled to at least one of the doors 54 to establish a surface against which a seal provided to the other one of the doors 54 can seal the entrance to the fresh food compartment 52 at a location between opposing side surfaces 56 (FIG. 2) of the doors 54. The mullion 58 can be pivotally coupled to the door 54 to pivot between a first orientation that is substantially parallel to a planar surface of the door 54 when the door 54 is closed, and a different orientation when the door 54 is opened. The externally-exposed surface of the center mullion 58 is substantially parallel to the door 54 when the center mullion 58 is in the first orientation, and forms an angle other than parallel relative to the door 54 when the center mullion 58 is in the second orientation. In the embodiment shown in FIG. 1, the seal and the externally-exposed surface of the mullion 58 cooperate at a position offset from a centerline midway between the lateral sides of the fresh food compartment 52. It is contemplated that the seal and the externally-exposed surface of the mullion 58 can cooperate approximately midway between the lateral sides of the fresh food compartment 52.

Turning back to FIG. 1, a dispenser 62 for dispensing at least ice pieces, and optionally water, can be provided on an exterior of one of the doors 54 that restricts access to the fresh food compartment 52. The dispenser 62 includes a lever, switch, proximity sensor or other device that a user can interact with to cause frozen ice pieces to be dispensed from an ice bin (not shown) of an ice maker 64 disposed within the fresh food compartment 52. Ice pieces from the ice maker 64 can exit the ice maker 64 through an aperture (not shown) and be delivered to the dispenser 62 via an ice chute (not shown), which extends at least partially through the door 54 between the dispenser 62 and the ice maker.

In alternative embodiments, the ice maker may be located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

Referring again to FIG. 2, the freezer compartment 100 is arranged vertically beneath the VCZ compartment 150. A drawer assembly 102 including one or more freezer baskets 104 can be withdrawn from the freezer compartment 100 to grant a user access to food items stored in the freezer compartment 100. The drawer assembly 102 can be coupled to a freezer door 106 that includes a handle 108. When a user grasps the handle 108 and pulls the freezer door 106 open, at least one or more of the freezer baskets 104 is caused to be at least partially withdrawn from the freezer compartment 100.

Figure 2:
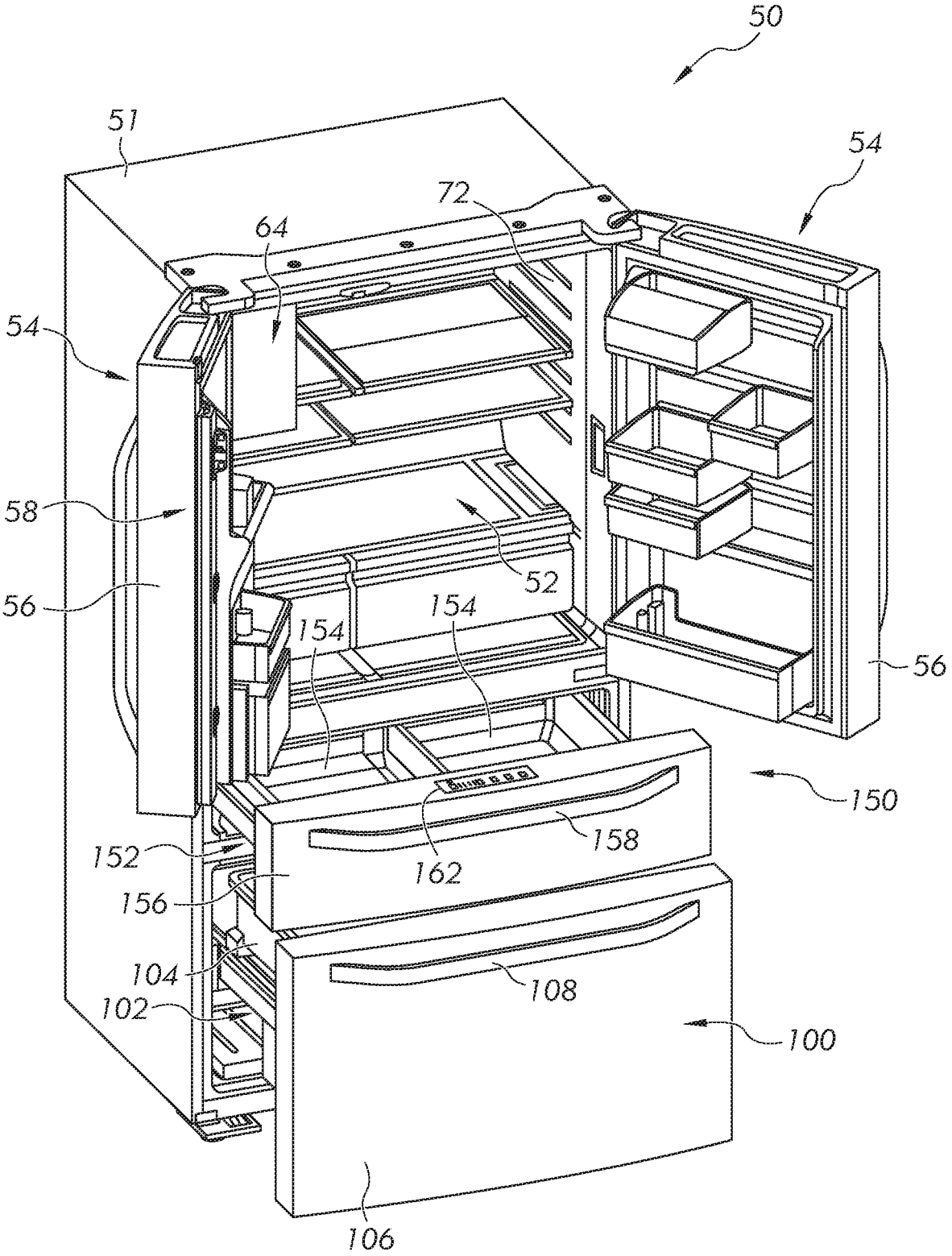
FIG. 2 is a front perspective view of the refrigerator of FIG. 1 showing the doors in an opened position and an interior of a fresh food compartment.

Referring to FIG. 2, the refrigerator 50 includes an interior liner 72 formed to define an upper compartment and a lower compartment. The upper compartment 74 defines the fresh food compartment 52 which serves to minimize spoiling of articles of food stored therein. The fresh food compartment 52 accomplishes this by maintaining the temperature in the fresh food compartment 52 at a cool temperature that is typically above 0° C., so as not to freeze the articles of food in the fresh food compartment 52. It is contemplated that the cool temperature preferably is between 0° C. and 10° C., more preferably between 0° C. and 5° C., and even more preferably between 0.25° C. and 4.5° C. A fresh food evaporator (shown later in FIG. 4) is dedicated to separately maintaining the temperature within the fresh food compartment 52 independent of the freezer compartment 100. According to an embodiment, the temperature in the fresh food compartment 52 can be maintained at a cool temperature within a close tolerance of a range between 0° C. and 4.5° C., including any subranges and any individual temperatures falling with that range. For example, other embodiments can optionally maintain the cool temperature within the fresh food compartment 52 within a reasonably close tolerance of a temperature between 0.25° C. and 4° C.

The upper compartment and the lower compartment of the liner 72 are configured such that the air circulated in the upper compartment is maintained separated from the air circulated in the lower compartment. The lower compartment defines the freezer compartment 100 and the VCZ compartment 150. In this respect, the air circulated in the fresh food compartment 52 is maintained separated from the air circulated in the VCZ compartment 150 and the freezer compartment 100.

The freezer compartment 100 is used to freeze and/or maintain articles of food stored in the freezer compartment 100 in a frozen condition. For this purpose, the freezer compartment 100 is in thermal communication with a freezer evaporator (not shown in FIG. 2) that removes thermal energy from the freezer compartment 100 to maintain the temperature therein at a temperature of 0° C. or less during operation of the refrigerator 50, preferably between 0° C. and −50° C., more preferably between 0° C. and −30° C. and even more preferably between 0° C. and −20° C. The freezer evaporator is dedicated to separately maintaining the temperature within the freezer compartment 100 independent of the fresh food compartment 52.

The ice maker 64 may include a designated evaporator dedicated to separately maintaining the temperature within the ice maker 64 independent of the fresh food compartment 52 and the freezer compartment 100. Alternatively, the ice maker evaporator can be a remote part of the freezer evaporator.

Negative temperature coefficient (NTC) thermistors, such as a fresh-food compartment temperature sensor 56 and a freezer temperature sensor 58 (discussed with reference to FIG. 3A and FIG. 5 below) can be provided inside the fresh food compartment 52 and the freezer compartment 100 for sensing the fresh-food compartment temperature and the freezer compartment temperature, respectively. The cooling/refrigeration system of a refrigerator cools the storage compartments (e.g., the freezer, fresh-food compartment, and/or the ice maker) of the refrigerator. The refrigeration system can include either a standard compressor or a variable speed compressor, a condenser, a condenser fan, and an evaporator connected in series and charged with a refrigerant from the compressor, and an evaporator fan. The evaporator fan circulates cooling air through the refrigerator compartments and improves heat transfer efficiency. The condenser expels heat withdrawn by the evaporator from the fresh food compartment 52 and the freezer compartment 100, respectively.

Figure 3A:
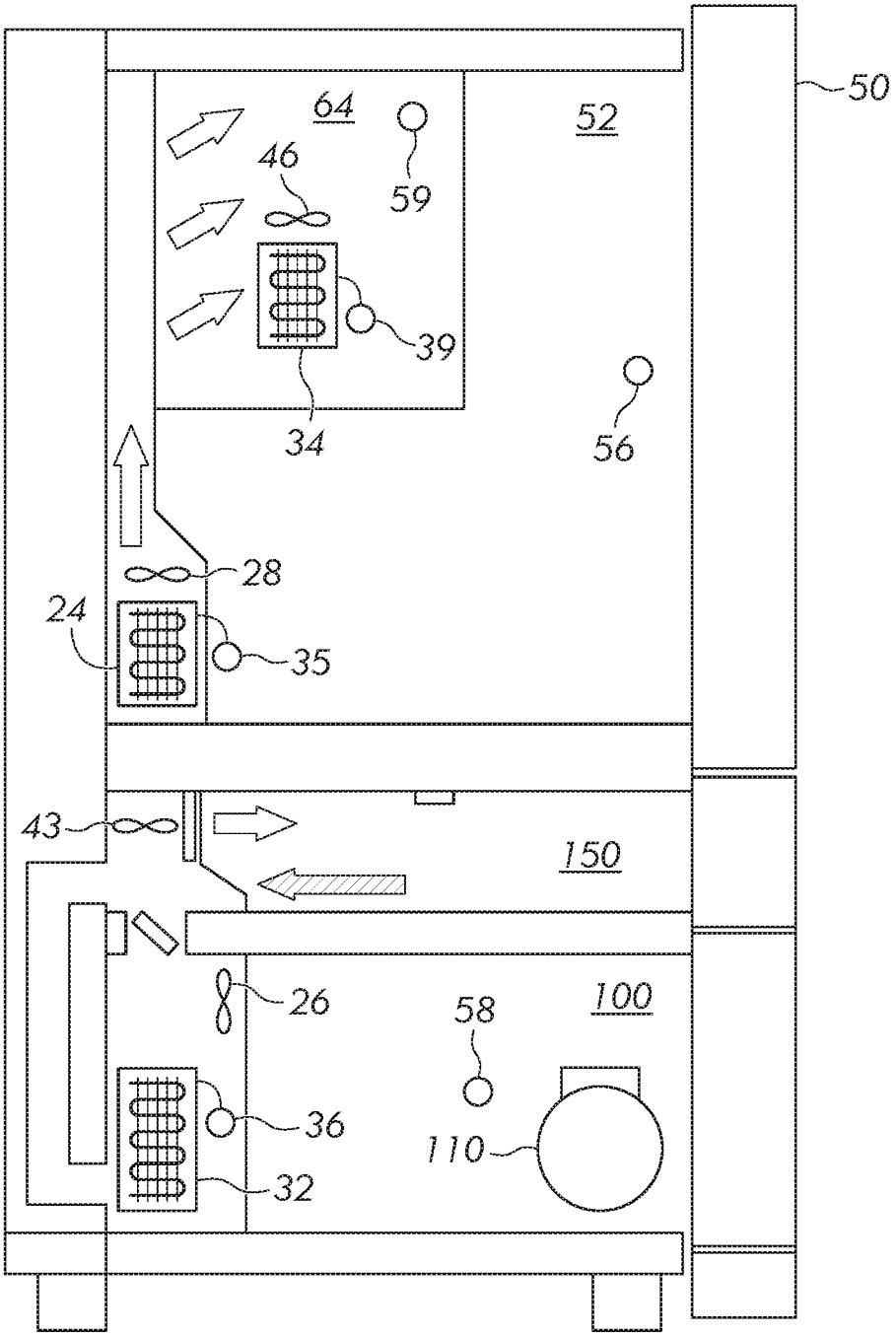
FIG. 3A is a diagram of an example cooling/refrigeration system of a refrigerator.
Figure 3B:
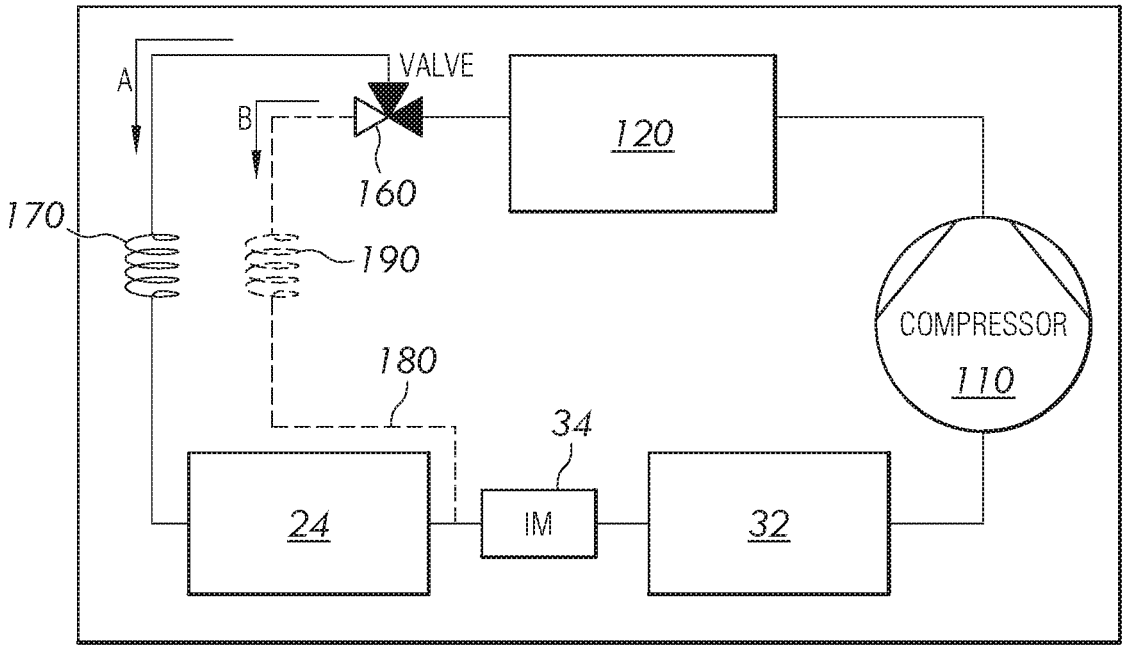
FIG. 3B is a schematic diagram of an example refrigeration circuit of a refrigerator.

Referring to FIG. 3A and FIG. 3B, an example cooling/refrigeration system (e.g., a refrigeration circuit) of a refrigerator 50 includes a compressor 110, a condenser 120 connected to the compressor 110, a three-way-valve 160 connected to the condenser 120, and three separate evaporators—a fresh food compartment evaporator 24 located in the fresh-food compartment 52, a freezer evaporator 32 located in the freezer compartment 100, and an ice maker evaporator 34 located in the ice maker 64. Negative temperature coefficient (NTC) thermistors, such as a fresh-food compartment temperature sensor 56, a freezer temperature sensor 58, and an ice maker temperature sensor 59 can be provided inside the fresh food compartment 52, the freezer compartment 100, and the ice maker 64, for sensing the fresh-food compartment temperature, the freezer compartment temperature, and the ice maker temperature, respectively. A freezer evaporator temperature sensor 36, a fresh food evaporator temperature sensor 35, and an ice maker evaporator temperature sensor 36 can be located on or near the freezer evaporator 32, the fresh food evaporator 24, and the ice maker evaporator 34, for sensing the temperature of the freezer evaporator 32, the fresh food evaporator 24, and the ice maker evaporator 34, respectively.

A fresh food evaporator fan 28, a freezer evaporator fan 26, and an ice maker evaporator fan 46 may be located in the vicinity of the fresh food compartment evaporator 24, the freezer evaporator 32, and the ice maker evaporator 34, respectively. An additional fan 43 may be disposed in the VCZ compartment 150 for circulating the air within the VCZ compartment 150. The circulation of cooling air for the fresh food compartment 52 is separate from the circulation of cooling air for the freezer compartment 100 and the VCZ compartment 150.

Referring to FIG. 3B, the components of the refrigeration circuit are connected in the foregoing order and define a first flow path "A". The ice maker evaporator 34 is arranged upstream the freezer evaporator 32. The valve 160 and a first capillary tube 170 are disposed in the first flow path "A" at a location downstream of the condenser 120 between the condenser 120 and the fresh food evaporator 24. The valve 160 is a three-way valve having an inlet connected to the condenser 120 and a first outlet connected to the first capillary tube 170. A second outlet of the valve 160 is connected to a by-pass line 180 that connects to the first flow path "A" at a location between the fresh food evaporator 24 and the ice maker evaporator 34. A second capillary tube 190 is disposed in the by-pass line 180. The by-pass line 180 defines a second flow path "B" that bypasses the first capillary tube 170 and the fresh food evaporator 24. During operation, the valve 160 can be in either a first position wherein the inlet and the first outlet of the valve 160 are fluidly connected, or a second position wherein the inlet and the second outlet of the valve 160 are fluidly connected. When the valve 160 is in the first position, the compressor 110 conveys a refrigerant along the first flow path "A" through the fresh food evaporator 24, the ice maker evaporator 34, and the freezer evaporator 32. When the valve 160 is in the second position, the valve 160 causes the refrigerant to flow along through the by-pass line 180 thereby bypassing the fresh food evaporator 24. The valve 160 is in the first position when it is desired to cool the corresponding fresh food compartment 52, freezer compartment 100, and ice maker 64. The valve 160 moves to the second position when the fresh food compartment 52 has reached the desired temperature. In this position, the fresh food evaporator 24 is bypassed but the refrigerant continues to circulate through the ice maker evaporator 34 and the freezer evaporator 32.

The three-way valve 160 is changed over so that the refrigerant from the compressor 110 flows to the fresh food compartment evaporator 24 or to the freezer evaporator 32. For example, in a fresh food compartment cooling mode, the three-way valve 160 can be changed over so that the refrigerant flows to the fresh food compartment evaporator 24 and the freezer evaporator 32. When the fresh food evaporator fan 28 and the freezer evaporator fan 26 are running, cooled air is sent to the fresh food 52 and the freezer compartment 100, cooling these compartments. In the freezing mode, the three-way valve 160 is changed over so that the refrigerant flows only to the freezer evaporator 32 and only the freezer evaporator fan 26 is driven. In the freezing mode, cold air cooled by the freezer evaporator 32 is sent only to the freezer compartment 100 by the freezer evaporator fan 26. No cold air is sent to the fresh food compartment 52. When three-way-valve 160 is in an ice maker/freezer position, the fresh food evaporator fan 28 runs for a predetermined operating time (about 10 minutes), while the compressor 110 is on. This operation ensures a continuous defrosting (or dynamic defrosting) of the fresh food evaporator 24, while the compressor 110 is on. This operation is synergetic with the defrosting cycle to be performed when the compressor is off and to be explained in details below, so that the fresh food evaporator is defrosted predominantly and (preferably) substantially only by the fresh food evaporator fan 28 without activating the fresh food defrost heater 31.

Figure 4:
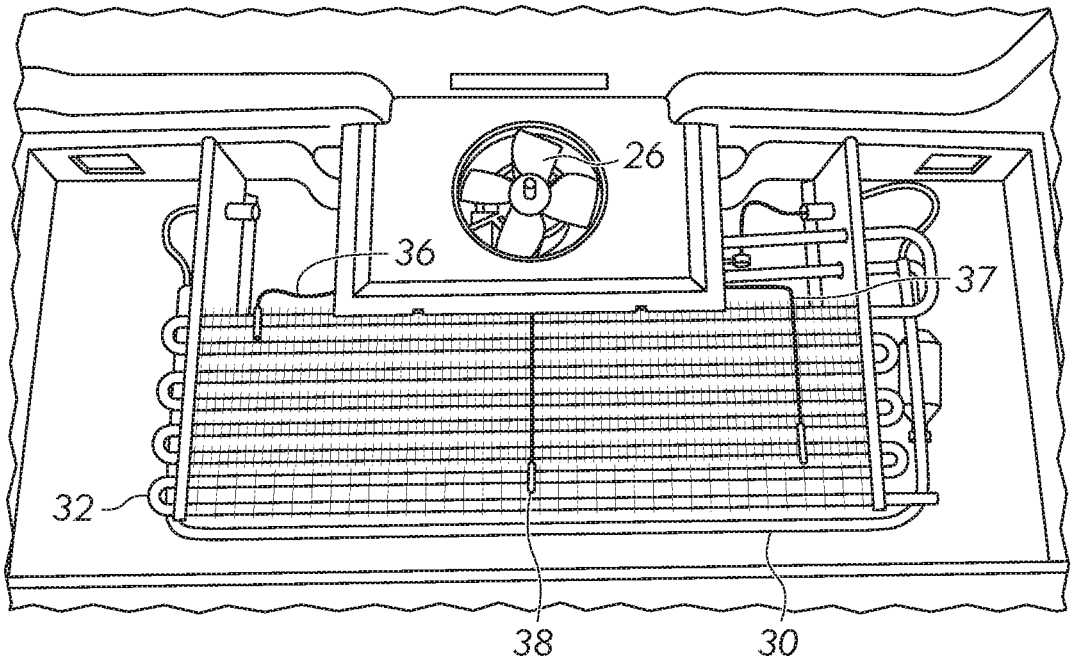
FIG. 4 is a perspective view of an example evaporator assembly.

FIG. 4 is a perspective view of an example evaporator 32 that can be located within the refrigerator 50, such as within the freezer compartment 100, for cooling the freezer compartment 100, for example. A similar configuration may be provided for the evaporators 24 and 34 associated within the fresh food compartment 52 and the ice maker 64, respectively. A fan 26 moves air from the freezer compartment 100 across the evaporator 32 to cool the air, and discharges the cooled air back into the freezer compartment 100. A defrost heater 30 can be mounted near the evaporator 32 for removing ice from the evaporator 32. The defrost heater 30 shown in FIG. 4 can surround the evaporator 32 on three sides. However, the defrost heater 30 could be mounted in other positions relative to the evaporator 32, such as behind the evaporator 32, underneath the evaporator 32, directly on the evaporator 32, etc. A similar defrost heater 33 configurations is provided for the evaporator 34 associated within the ice maker 64. Additionally a similar defrost heater 31 configurations may be provided for the evaporators 24 associated within the fresh food compartment 52. However in a further preferred embodiment, the fresh food compartment 52 does not include any defrost heater.

The defrost heater 30 described herein is operated according to an "adaptive defrost" scheme in which the period between defrosting cycles is dynamically changed by a controller based on the time required to complete the most recent defrosting operation in certain operating conditions described below. Alternatively, the defrost heater 30 can be operated periodically, such as every 8 hours, every 10 hours, etc. to defrost the evaporator 32. The defrost heater 30 could further be operated based on sensing a build-up of ice on the evaporator 32.

Referring again to FIG. 4, freezer evaporator temperature sensors 36, 37, 38 (e.g., thermocouple, RTD, negative temperature coefficient (NTC) thermistors, etc.) can be located on or near the evaporator 32 for sensing the temperature of the freezer evaporator 32. The temperature sensors 36, 37, 38 generate respective temperature signals based on the evaporator temperature. Although three freezer temperature sensors 36, 37, 38 are shown in FIG. 4, it is to be appreciated that any number of freezer temperature sensors can be used as desired, such as one temperature sensor, two temperature sensors, four temperature sensors, etc. The evaporator 32 can have various "cold spots" that are the last spots on the evaporator to be defrosted, and it might be desirable to locate temperature sensors at such cold spots to help determine when the evaporator 32 is completely defrosted.

Figure 5:
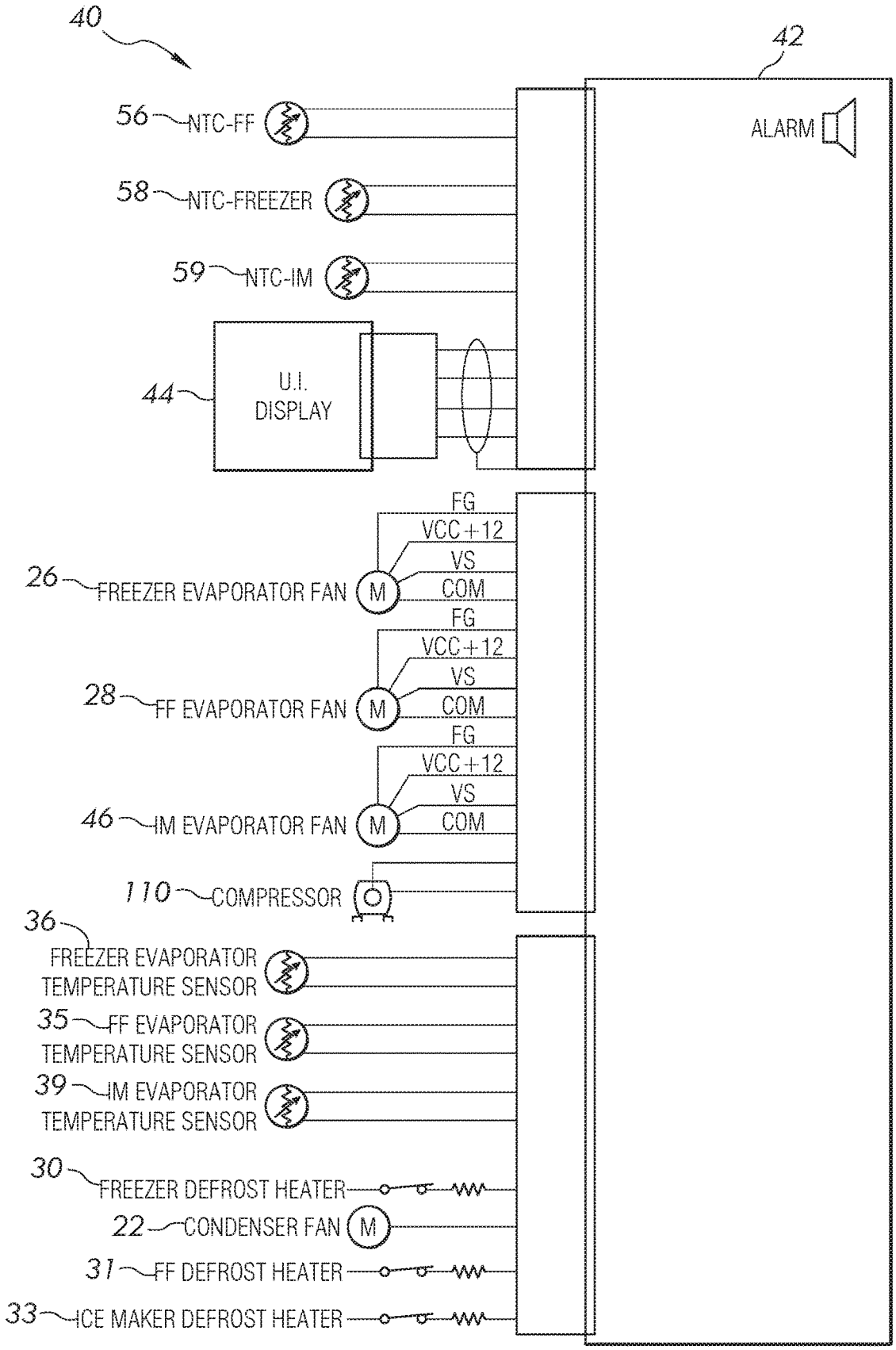
FIG. 5 is a schematic diagram of an example electronic control system.

Referring to FIG. 5, the refrigerator 50 can further include an electronic microprocessor-based control system 40 for controlling the refrigeration components, such as the compressor 110, the condenser and condenser fan 22, the freezer evaporator fan 26, the defrost heaters, as well as non-refrigeration components, such as a user interface, indicator lights, alarms, etc. The control system 40 may include a main control board or controller 42 and a user interface/display board 44.

The controller 42 can be an electronic controller and may include a processor. The controller 42 can include one or more of a microprocessor, a microcontroller, a digital signal processor (DSP), an application specific integrated circuit (ASIC), a field-programmable gate array (FPGA), discrete logic circuitry, or the like. The controller 42 can further include a timer that that keep track of, or counts, various time intervals described herein. The controller 42 can also include memory and may store program instructions that, when executed by the controller 42, cause the controller to provide the functionality ascribed to it herein. Specifically, the controller 42 is programmed to control the defrost heaters to carry out the adaptive defrost method described below. The memory may include one or more volatile, non-volatile, magnetic, optical, or electrical media, such as read-only memory (ROM), random access memory (RAM), electrically-erasable programmable ROM (EEPROM), flash memory, or the like. The controller 42 can further include one or more analog-to-digital (A/D) converters for processing various analog inputs to the controller. The controller 42 can be a dedicated controller that is used substantially only for controlling defrosting operations, or the controller can control a plurality of functions commonly associated with a refrigeration appliance, such as the temperature of the refrigeration compartments, activating the compressor and the condenser fan, and the like.

The user interface/display board 44 can communicate with the main control board 42 and can include communication means in the form of multiple control switches of any type known in the art to allow the user to communicate with the main control board 42. The user interface/display board 44 can further include a display portion for conveying information to the user. The display portion may be any type of display known in the art, such as a two-digit, 7-segment display that displays temperature either in degrees Fahrenheit or Celsius or a single-digit, 7-segment display that displays a temperature setting from 1 to 9.

The controller 42 can include input/output circuitry for interfacing with the various system components. For example, the controller 42 can receive and interpret temperature signals from sensors 35, 36, 37, 38, 39, 56, 58, and 59, and processes these signals to control the operation of the refrigeration and non-refrigeration components described above based on these signals. Specifically, inputs to the controller 42 can be provided from the freezer, the fresh-food compartment, and the ice maker temperature sensors 56, 58, 59, from at least one of the evaporator temperature sensor(s) 35, 36, 39, from the user interface 44, and from the compressor 110. Outputs from the controller 42 can control at least the energization of the defrost heaters, the compressor 110, the evaporator fans 26, 28, 46, and the condenser fan 22. The controller 42 can be connected to output alarm devices, such as light emitting elements or sound emitting elements. The controller 42 can also initiate regular defrost operations at standard intervals, which may be stored in the memory of the controller 42 to be selected according to the operating conditions of the refrigeration system described below.

The controller 42 drives the compressor 110 and the evaporator fans 26, 28, 46 based on the temperature detected from the sensors 56, 58, 59 located in the fresh food compartment 52, the freezer compartment 100, and the ice maker 64, and the temperatures set by the user. That is, the controller 42 drives the compressor 110 and the evaporator fans 26, 28, 46 until the inner temperature of the fresh food compartment 52, the freezer compartment 100, and the ice maker 64 reaches the temperatures set by the user.

The defrost control method described below calculates and simultaneously controls the defrost interval (e.g., the time period between the last or previous defrost cycle and the next defrost cycle) of three evaporators, each located in the fresh food compartment 52, the freezer 100, and the ice maker 64, respectively. The ice maker evaporator 34 can be a remote part of the freezer evaporator 32. The method controls the defrost intervals of these three evaporators by executing the same algorithm for each evaporator in parallel (e.g., at the same time) using as inputs the temperature of each evaporator, the length of the defrost cycle for each evaporator, and the number and duration of door openings of the respective compartments.

Figure 6:
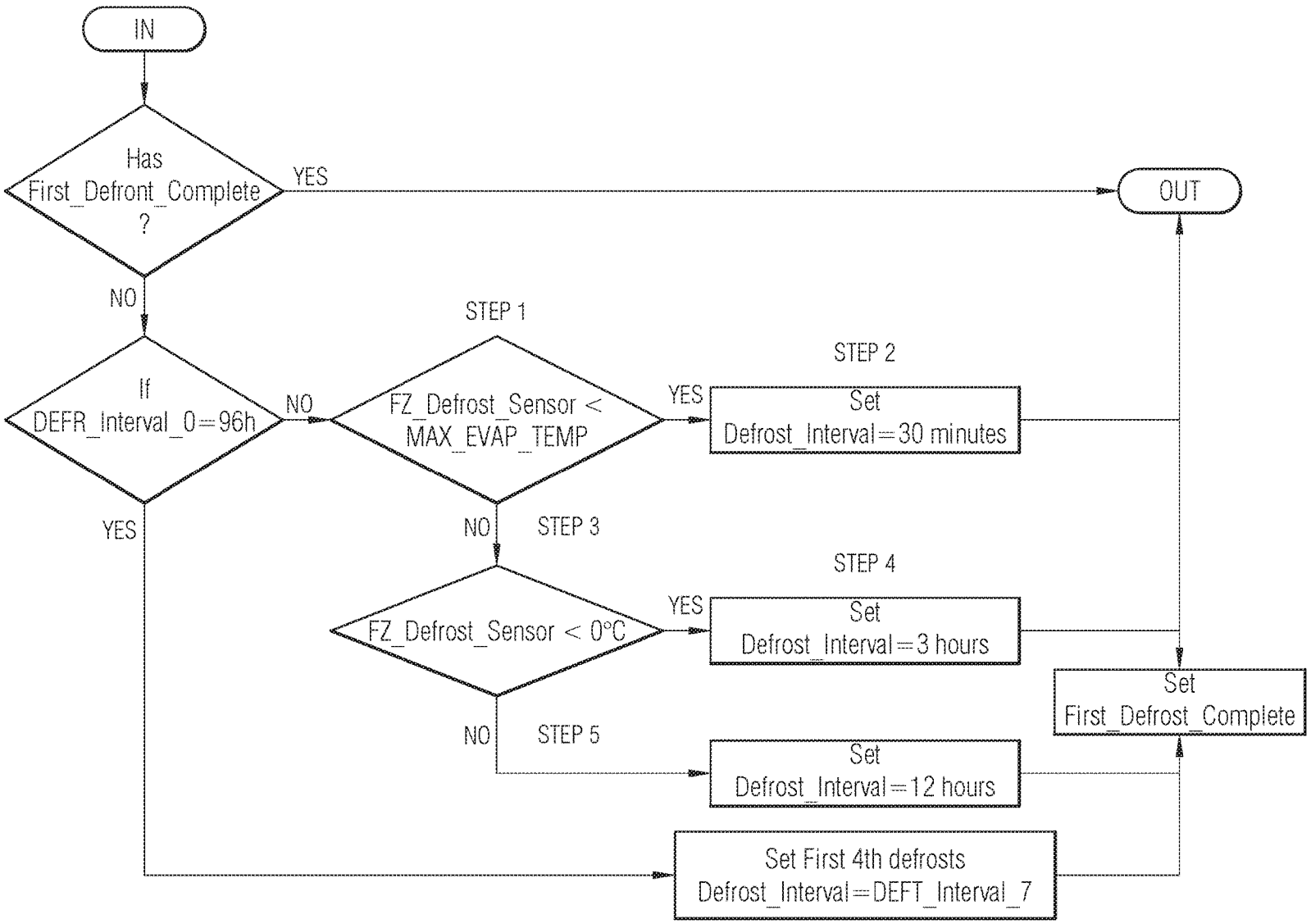
FIG. 6 is a flowchart illustrating a defrost initialization of the freezer evaporator.

Referring to FIG. 6, before the defrost process for all evaporators starts, the controller 42 initializes each defrost heater by setting a default defrost interval DEFR_Interval (e.g., the time period between the last or previous defrost cycle and the next defrost cycle) for defrosting each of the three evaporators at a predetermined period of time. Specifically, the default defrost interval DEFR_Interval may be set at 96 hours in the United States, at 48 hours in Europe and Brazil, and at 24 hours in Australia, for example (different countries use different first defrost intervals). At the same time, during the running of the default defrost interval DEFR_Interval (e.g., before the default defrost interval DEFR_Interval elapses), in Step 1, the controller 42 compares the temperature of the freezer evaporator (measured by the freezer evaporator temperature sensor) FZ_Defrost_Sensor with a predetermined maximum evaporator temperature MAX_EVAP_TEMP, simultaneously for each evaporator. For example, the temperature of the freezer evaporator (measured by the freezer evaporator sensor) FZ_Defrost_Sensor is compared to a predetermined maximum evaporator temperature MAX_EVAP_TEMP for the freezer evaporator (typically set at −15° C. in all countries). If the temperature of the freezer evaporator FZ_Defrost_Sensor is lower than the predetermined maximum evaporator temperature MAX_EVAP_TEMP (e.g., −15° C.), in Step 2 the controller 42 sets the defrost interval DEFR_Interval at 30 minutes. If the temperature of the freezer evaporator FZ_Defrost_Sensor is not lower than the predetermined maximum evaporator temperature MAX_EVAP_TEMP, in Step 3 the controller 42 checks whether the temperature of the freezer evaporator FZ_Defrost_Sensor is lower than 0° C. If the temperature of the freezer evaporator FZ_Defrost_Sensor is lower than 0° C., in Step 4 the controller 42 sets the defrost interval DEFR_Interval at 3 hours. If the temperature of the freezer evaporator FZ_Defrost_Sensor is not lower than 0° C., in Step 5 the controller 42 sets the defrost interval DEFR_Interval at 12 hours. In other words, the lower the temperature of the freezer evaporator FZ_Defrost_Sensor is, the shorter the defrost intervals subsequent to the default defrost interval DEFR_Interval are. On the other hand, the higher the temperature of the freezer evaporator FZ_Defrost_Sensor is, the longer the defrost intervals subsequent to the default defrost interval DEFR_Interval are.

Figure 7:
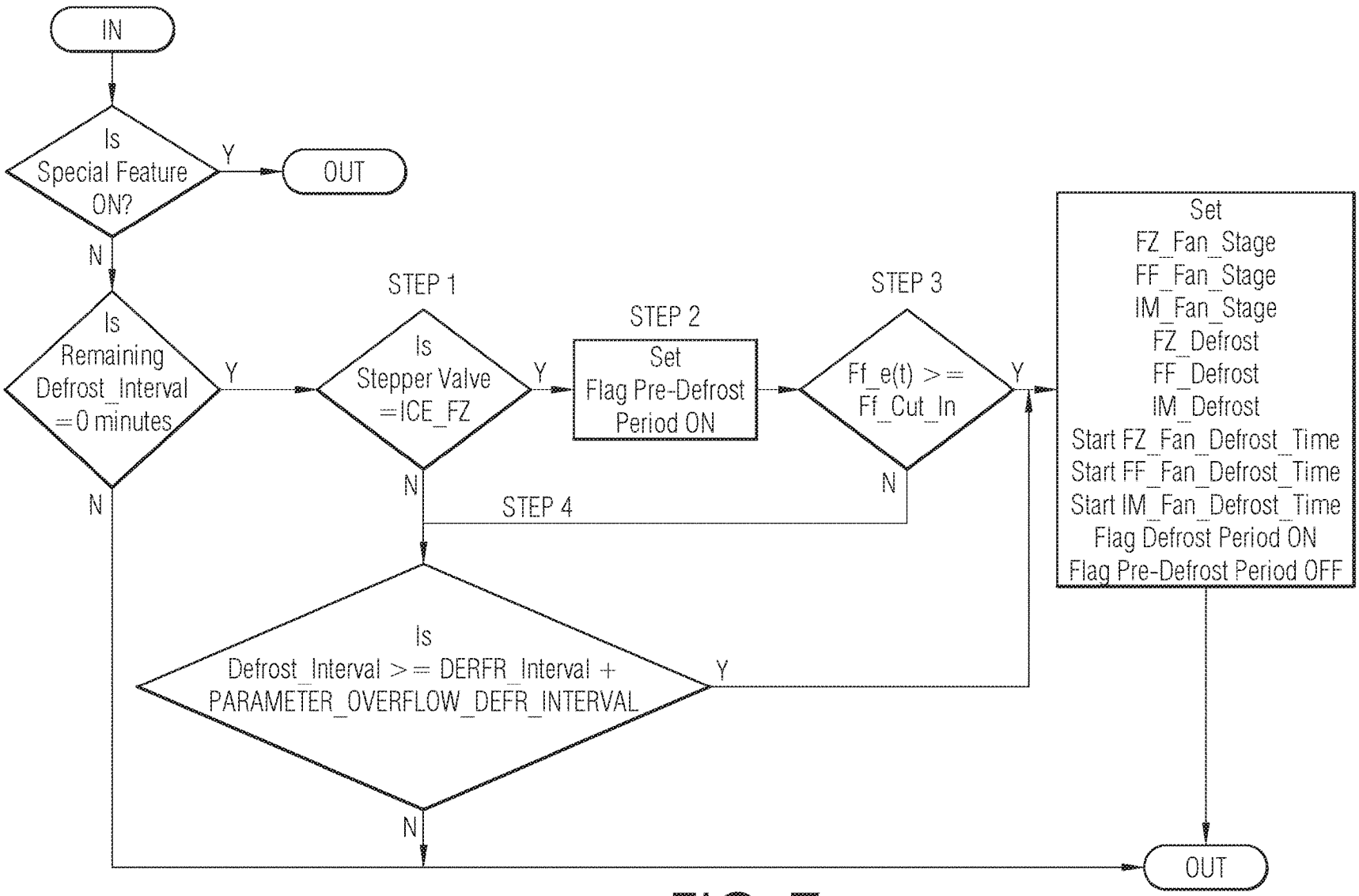
FIG. 7 is a flowchart illustrating a boost before defrost process.

Referring to FIG. 7, when the remaining defrost interval time is zero (e.g., the defrost interval DEFR_Interval has elapsed), in Step 1 the controller 42 checks whether the three-way valve is in an ice maker/freezer position. If the three-way valve is in an ice maker/freezer position, in Step 2 the controller 42 checks the temperature Ff_e(t) of the fresh food compartment 52. If the temperature Ff_e(t) of the fresh food compartment 52 is equal to or above a user-selected set point temperature Ff_Cut_In, in Step 2 the controller 42 initiates a defrost procedure for the evaporators of all compartments. If the temperature Ff_e(t) of the fresh food compartment 52 is not equal to or above a user-selected set point temperature, in Step 4 the controller 42 waits up to one hour before starting the defrost procedure for the evaporators associated with all compartments. The reason for this delay is to avoid the start of the defrost procedure (e.g., heat the evaporators) when the fresh food compartment 52 is requesting cooling, which inhibits waste of energy. If the three-way valve is in the other position, e.g., in the fresh food compartment 52 position, which means the fresh food compartment 52 is under cooling, once again, the system waits up to one hour before starting the defrost procedure (Step 4), for the same reason.

Figure 8A:
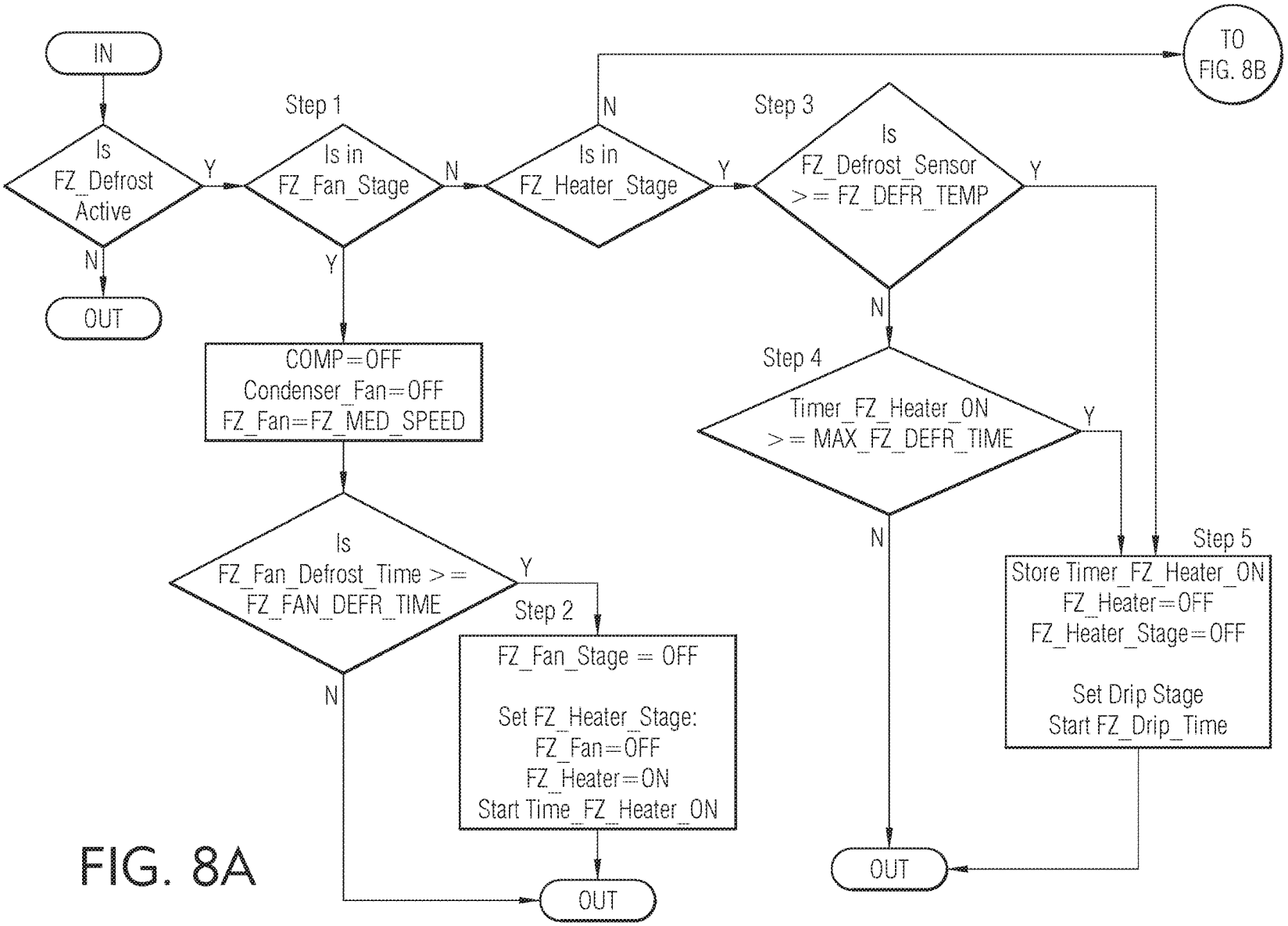
FIG. 8A is a flowchart illustrating a defrost process of the freezer evaporator.
Figure 8B:
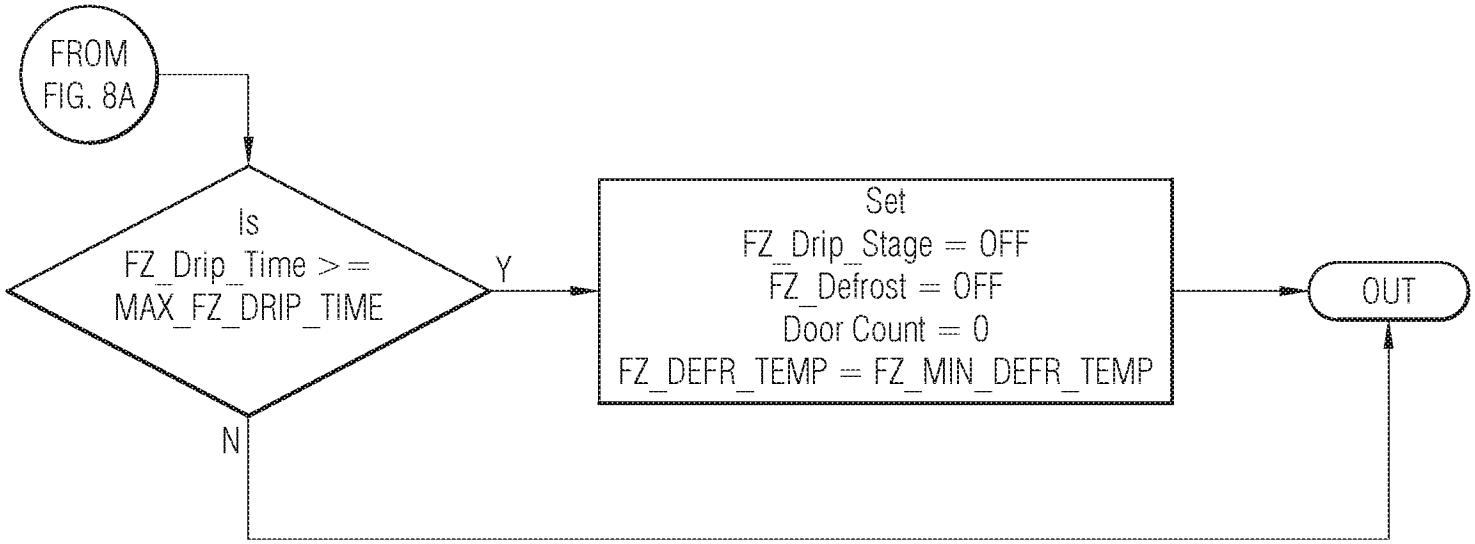
FIG. 8B is a flowchart illustrating the defrost process of the freezer evaporator.

FIG. 8 illustrates the defrost process for the freezer compartment 100. Similar process, with some variations (described below), is executed for the fresh food compartment 52 and for the ice making compartment 50. When the defrost cycle begins (e.g., after the defrost interval DEFR_Interval has elapsed), as a first step of the defrost cycles for all defrost cycles in all compartments, except for the ice-maker (because running only the ice maker evaporator fan will be insufficient to defrost the ice maker evaporator), before turning on the defrost heaters, in Step 1 the controller 42 activates the evaporator fans located in the fresh food compartment 52 and the freezer compartment 100, respectively, while the compressor, the condenser fan, and the defrost heaters are turned off. Actually, it has been found that there are not particularly advantages in activating the ice maker fan 46 before activating the ice maker defrost heater 33, however some embodiments may comprise the activation of the ice maker fan 46. Running the fans maintains the temperature in the respective compartments by re-circulating warmer air generated by the evaporators in the respective compartments and defrosts the evaporators, without activating the defrost heaters. For some compartments, such as the fresh food compartment, as previously discussed, running the respective fan is sufficient for defrosting the evaporator in that compartment, and running the defrost heater may not be needed.

The evaporator fans run until reaching a predetermined maximum time period for running each fan. The predetermined time periods for running the fans may be set different for the respective compartments. For example, the fresh-food compartment evaporator fan can run for 42 minutes and the freezer evaporator fan can run for 5 minutes. However, embodiments are not limited thereto and other time periods may be selected for running the evaporator fans in the respective compartments. Regardless of the specific predetermined time period for running each of the evaporator fans, after the predetermined maximum time period for running each of the evaporator fans has been reached, in Step 2 the controller 42 proceeds with the second step of the defrost cycles by turning the evaporator fans off, turning the defrost heaters in the respective compartment on, and starting a timer to count the period of time each defrost heater has been on.

Referring again to FIG. 8, a predetermined defrost cut-off temperature for each compartment and a maximum time for running each defrost heater is set in advance for each compartment and each defrost heater, and the predetermined defrost cut-off temperature for each compartment and the maximum time for running each defrost heater are stored in the memory. For example, a predetermined defrost cut-off temperature for the freezer compartment FZ_DEFR_TEMP and a maximum time for running the freezer compartment defrost heater MAX_FZ_DEFR_TIME are set in advance for the freezer compartment and the freezer defrost heater. In Step 3, the controller 42 compares the temperature in the freezer compartment (measured by an evaporator temperature sensor in the freezer compartment FZ_Defrost_Sensor) to the predetermined defrost cut-off temperature for the freezer compartment FZ_DEFR_TEMP. If the temperature in the freezer compartment (measured by the evaporator temperature sensor in the freezer compartment FZ_Defrost_Sensor) is equal to or higher than the predetermined defrost cut-off temperature for the freezer compartment FZ_DEFR_TEMP, in Step 5 the controller 42 turns the freezer defrost heater off and stores the period of time the freezer defrost heater has been on in the memory. If the temperature in the freezer compartment (measured by the temperature sensor in the freezer compartment FZ_Defrost_Sensor) is not equal to or higher than the predetermined defrost cut-off temperature for the freezer compartment FZ_DEFR_TEMP, in Step 4, the controller 42 compares the time the freezer defrost heater has been on (counted by a timer) Timer_FZ_Heater_ON with the predetermined maximum time for running the freezer defrost heater MAX_FZ_DEFR_TIME. If the time the freezer defrost heater has been on (counted by the timer) Timer_FZ_Heater_ON is equal to or higher than the predetermined maximum time for running the freezer defrost heater MAX_FZ_DEFR_TIME, in Step 5 the controller 42 turns the freezer defrost heater off and stores the period of time the freezer defrost heater has been on in the memory. In other words, when either the defrost cut-off temperature for the freezer compartment FZ_DEFR_TEMP (measured by a temperature sensor in the freezer compartment) (Step 3) or the maximum time the freezer defrost heater has been on MAX_FZ_DEFR_TIME (counted by a timer) is reached (Step 4), in Step 5 the controller 42 turns the freezer defrost heater off and stores the period of time the freezer defrost heater has been on in the memory.

During the defrost cycle, melted frost from the evaporators drips in a drip pan. For a predetermined time "drip time" after the defrost heaters are turned off, but before the compressor is energized, each of the defrost heaters, the compressor, and the fans are turned off to allow moisture to drip from the evaporator coils. The "drip time" is set to allow most of the melted frost to drip from the evaporator, such as 3 minutes or a 2-5 minutes range. Referring again to FIG. 8, after the freezer defrost heater is turned off, the controller 42 waits for a predetermined "drip time" before ending the defrost process and turning on the compressor. When the FZ_Drip_Time is equal to or higher than a maximum predetermined "drip time" MAX_FZ_DRIP_TIME, the controller 42 terminates the freezer defrost process and turns on the compressor to resume the cooling operation of the compartments.

Figure 9A:
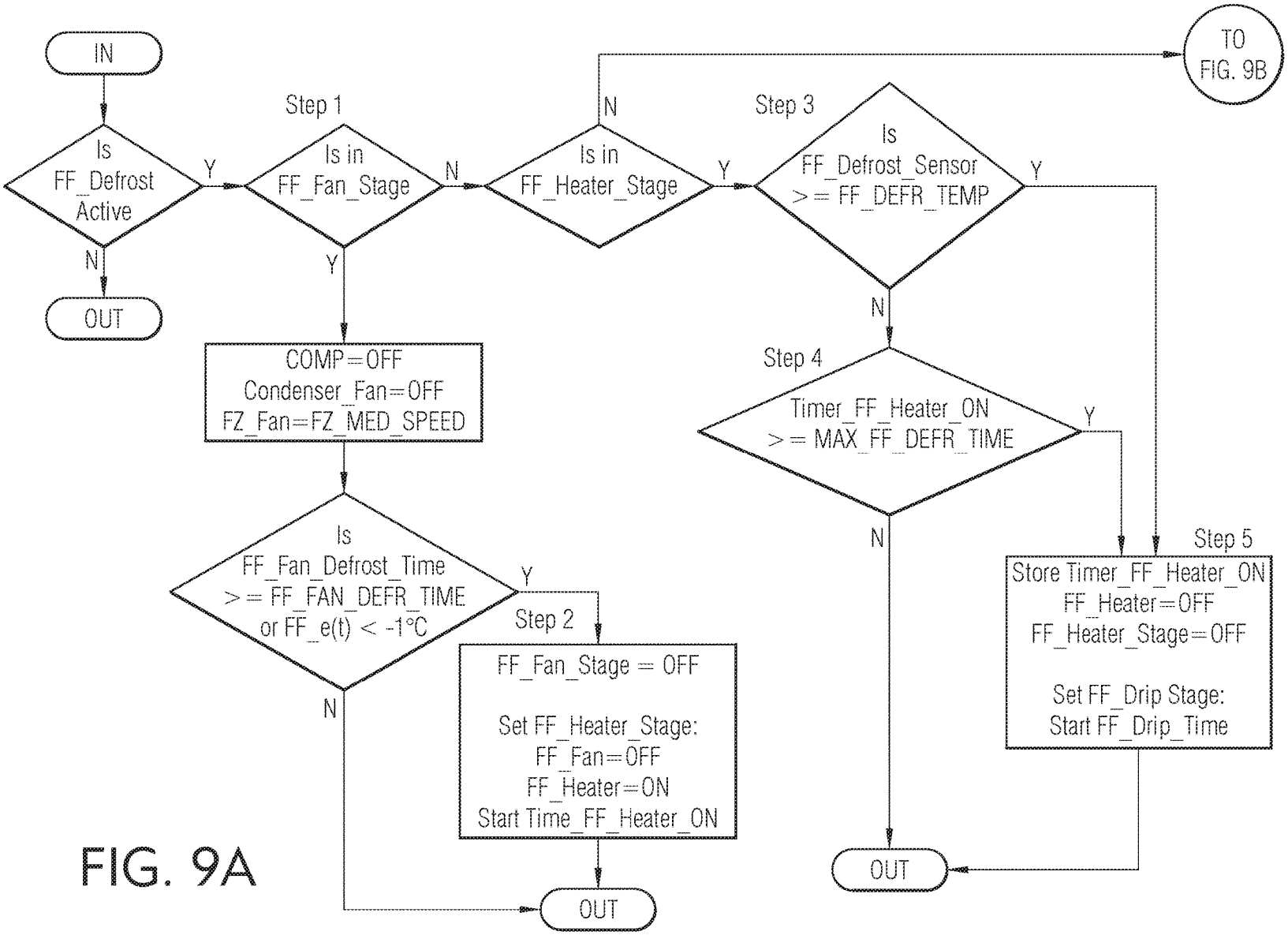
FIG. 9A is a flowchart illustrating a defrost process of the fresh-food compartment evaporator.
Figure 9B:
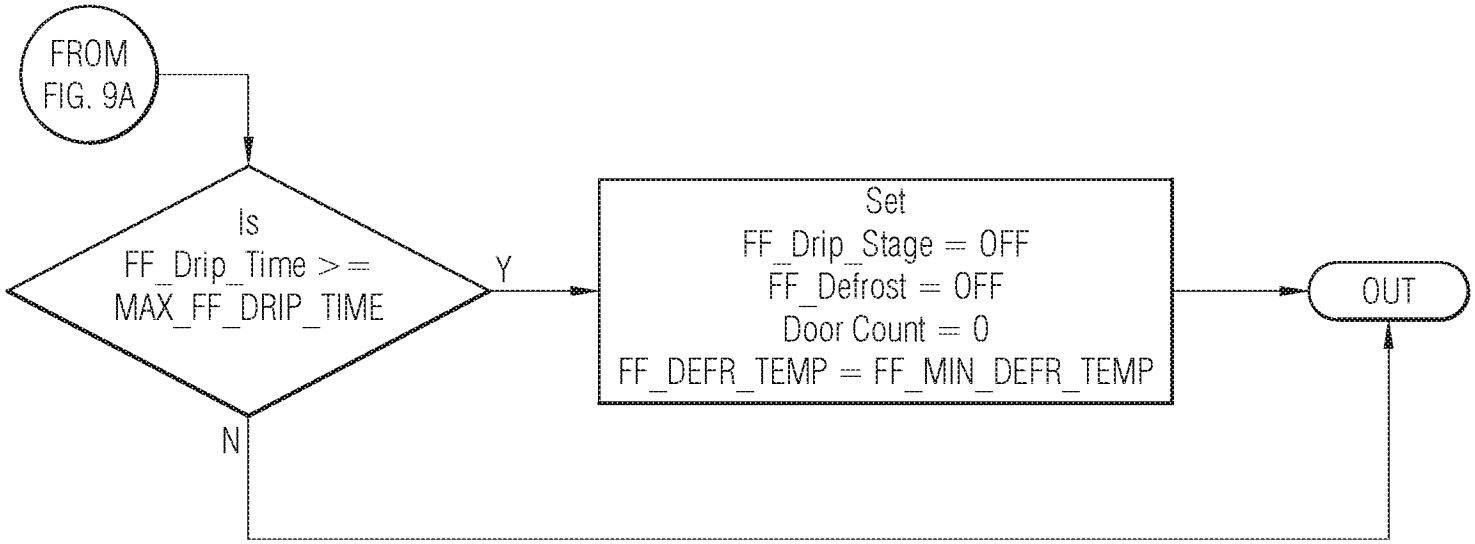
FIG. 9B is a flowchart illustrating the defrost process of the fresh-food compartment evaporator.

As discussed above, a similar defrost process to the one shown in FIG. 8 for the freezer compartment 100 is executed, in parallel (e.g., at the same time) for the fresh food compartment 52. Referring to FIG. 9, all steps in the defrost process for the fresh food compartment 52 are the same as the ones described above with reference to FIG. 8 above, except that, in addition to comparing the fresh food evaporator fan run time to the predetermined maximum time period for running the fresh food evaporator fan (decision before Step 2), the controller 42 also checks whether the temperature FF_e(t) of the fresh food compartment 52 is lower than −1° C. When either the fresh food evaporator fan run time has reached the predetermined maximum time period for running the fresh food evaporator fan or when the temperature FF_e(t) of the fresh food compartment 52 is lower than −1° C., in Step 2, the controller 42 proceeds with the second step of the defrost cycles by turning the fans off, turning the defrost heaters in the respective compartment on, and starting a timer to count the period of time each heater has been on. It is to be noted that the defrost process of the fresh food compartment 52 provides a rather long activation time of the fresh food evaporator fan 28, for example 42 minutes or a range of 35-50 minutes, which activation time is sufficient to completely defrost the fresh food compartment evaporator 24 in most of the cases. Additionally, the defrost cut-off temperature for the fresh food compartment FF_DEFR_TEMP is set to be a rather low value around 4° C., which immediately drives the deactivation of the fresh food compartment defrost heater without significantly increasing the temperature the of the defrost heater.

Likewise, a similar defrost process to the one shown in FIG. 8 for the freezer compartment 100 is executed, in parallel (e.g., at the same time) for the ice making compartment 50. All steps in the defrost process for the ice making compartment 50 are the same as the ones described above with reference to FIG. 8 for the freezer compartment 100.

Figure 10:
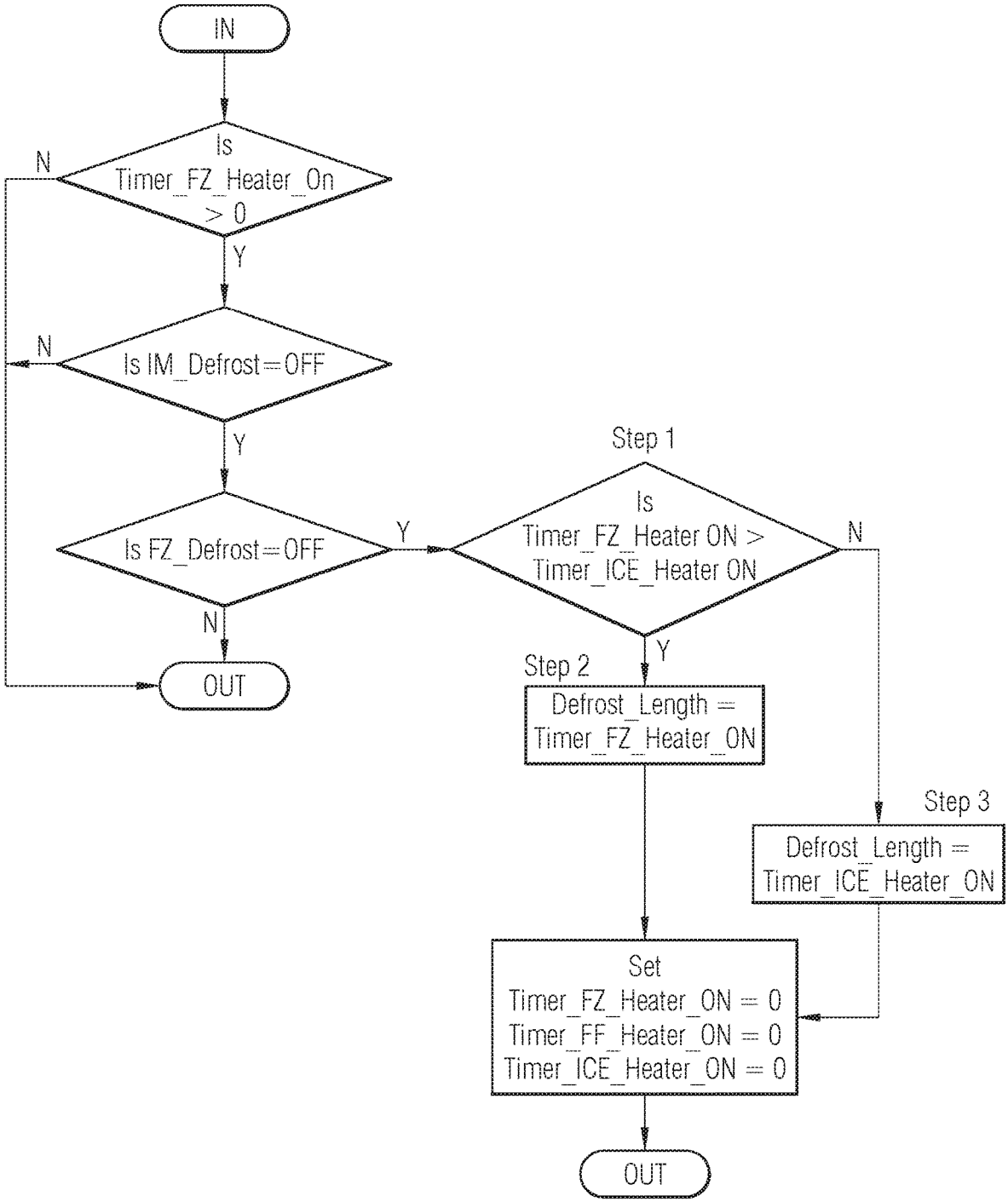
FIG. 10 is a flowchart illustrating a defrost length determination after defrost ends.

Referring to FIG. 10, after the defrost operation for each compartment ends, in Step 1 the controller 42 compares the heater activation periods (e.g., the maximum time the defrost heaters have been on) of the defrost heaters for the ice-maker 50 (Timer_ICE_Heater_ON) and the freezer compartment 100 (Timer_FZ_Heater_ON), selects the longer heater activation period between the defrost heaters for the ice-maker and the freezer compartment, and stores this longer heater activation period as a defrost length DEFR_Length (Step 2 and Step 3).

As described above, the default defrost interval (DEFR_interval_0) in the USA is 96 hours (e.g., maximum defrost interval) and the minimum defrost interval (DEFR_interval_7) in USA is 12 hours. The intermediate defrost intervals (DEFR_interval_1 to DEFR_interval_6) are calculated based on the defrost length DEFR_Length (e.g., the longer heater activation period between the defrost heaters for the ice-maker and the freezer).

Figure 11:
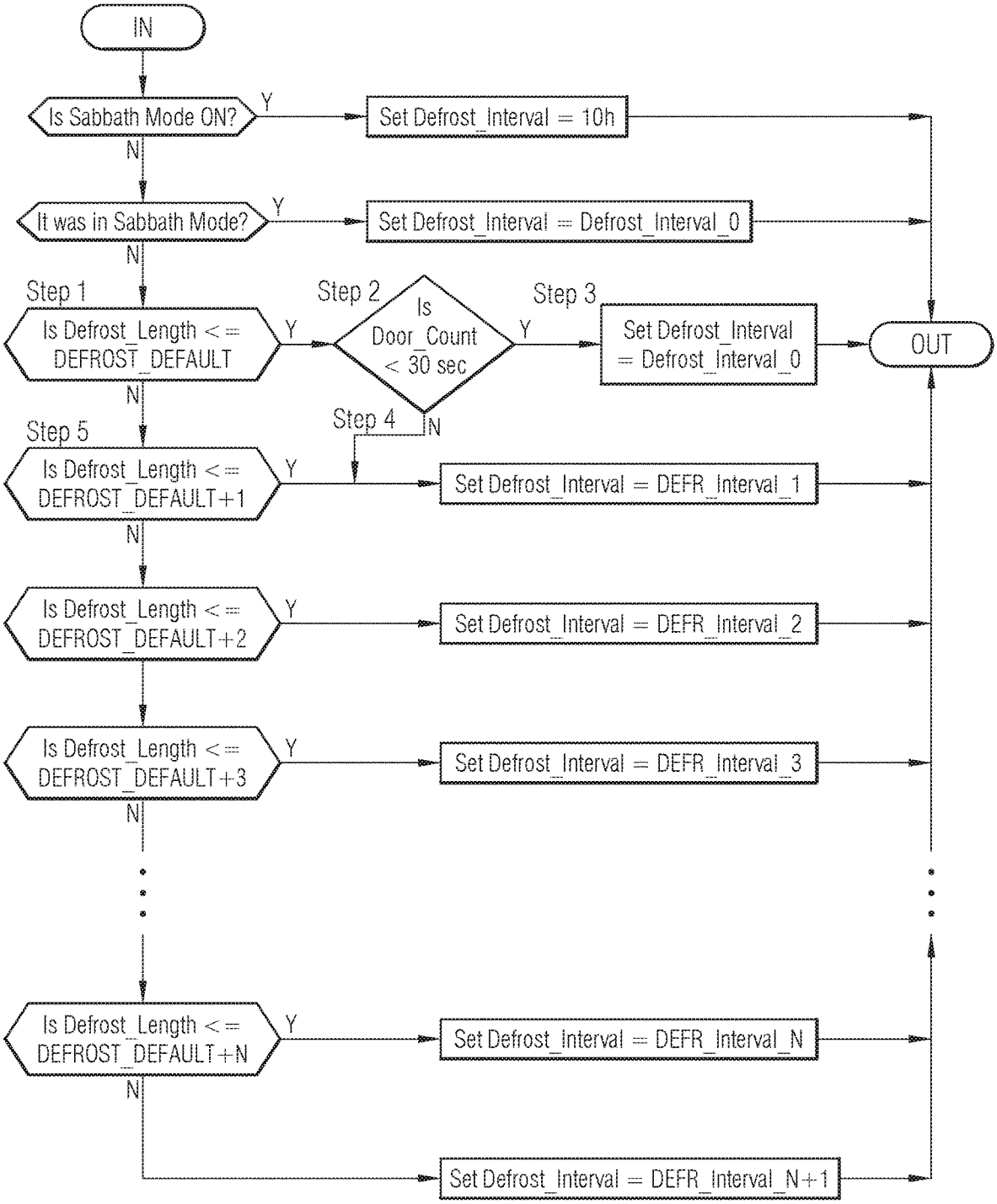
FIG. 11 is a flowchart illustrating a defrost interval reduction based on defrost length.

Referring to FIG. 11, the stored defrost length DEFR_Length is compared to each of the default defrost time thresholds DEFROST_DEFAULT, DEFROST_DEFAULT+1, DEFROST_DEFAULT+2, etc. stored in the memory of the controller 42. The first stored default defrost time threshold DEFROST_DEFAULT is typically 25 minutes.

The second default defrost time threshold DEFROST_DEFAULT+1 is 26 minutes. The third default defrost time threshold DEFROST_DEFAULT+2 is 27 minutes, and so on. When the defrost length DEFR_Length is less than or equal to any of the default defrost time thresholds, the controller 42 calculates the new intermediate defrost intervals (DEFR_interval_1 to DEFR_interval_6) using the formula: 12+PAR*(96−12), where the parameter PAR varies as shown in the table below:

| | |
|---|---|
| 0.58 | DEFR_interval_1 |
| 0.42 | DEFR_interval_2 |
| 0.28 | DEFR_interval_3 |
| 0.16 | DEFR_interval_4 |
| 0.08 | DEFR_interval_5 |
| 0.03 | DEFR_interval_6 |

For example, using the above formula and table, the new calculated DEFR_interval_1 is 12+0.58*(96−12)=60.72 hours, the new calculated DEFR_interval_2 12+0.42*(96−12)=47.2 hours, and so on. If the defrost length DEFR_Length is less than or equal to any of the default defrost time thresholds DEFROST_DEFAULT, DEFROST_DEFAULT+1, DEFROST_DEFAULT+2, etc., the controller 42 sets the defrost interval to the new calculated defrost interval. For example, in Step 1, the controller 42 checks whether the defrost length DEFR_Length is less than or equal to the first default defrost time threshold DEFROST_DEFAULT (e.g., 25 minutes). If the defrost length DEFR_Length is less than or equal to the first default defrost time threshold DEFROST DEFAULT (e.g., 25 minutes), in Step 2, preferably, the controller 42 checks whether the door of the respective compartment was opened for longer than 30 seconds (as monitored by a door open counter, discussed below). If the door of the respective compartment was opened for less than 30 seconds, in Step 3, the controller 42 sets the new defrost interval to be equal to the DEFR_interval_0 of 96 hours (in the USA). If the door of the respective compartment was opened for longer than 30 seconds, in Step 4, the controller 42 sets the new defrost interval to be equal to the calculated DEFR_interval_1 of 60.72 hours, which is shorter than the DEFR_interval_0 of 96 hours (in the USA). Next, in Step 5, if the defrost length DEFR_Length is less than or equal to the second default defrost time threshold DEFROST_DEFAULT+1 (e.g., 26 minutes), the new defrost interval is set to be equal to the calculated DEFR_interval_2 of 47.2 hours, which is shorter than both the DEFR_interval_0 of 96 hours (in the USA) and the calculated DEFR_interval_1 of 60.72 hours. In other words, the longer the defrost length DEFR_Length is, the shorter the defrost interval DEFR_interval_0 is.

At the same time (e.g., in parallel with comparing the stored defrost length DEFR_Length to the default defrost time thresholds), the controller 42 monitors situations directly or indirectly connected to door openings, as indicated by door sensors which provide signals to the controller 42 indicative of opening conditions of the doors of the compartments, after which the controller 42 stores data based on the door opening signals in the memory. Specifically, the controller 42 selects the defrost interval (the time period between the last defrost cycle and the next defrost cycle) from a table of values corresponding to the times between openings of the doors of the compartments and the durations of time the doors remain open. This table of values is also stored in the memory.

Figure 12A:
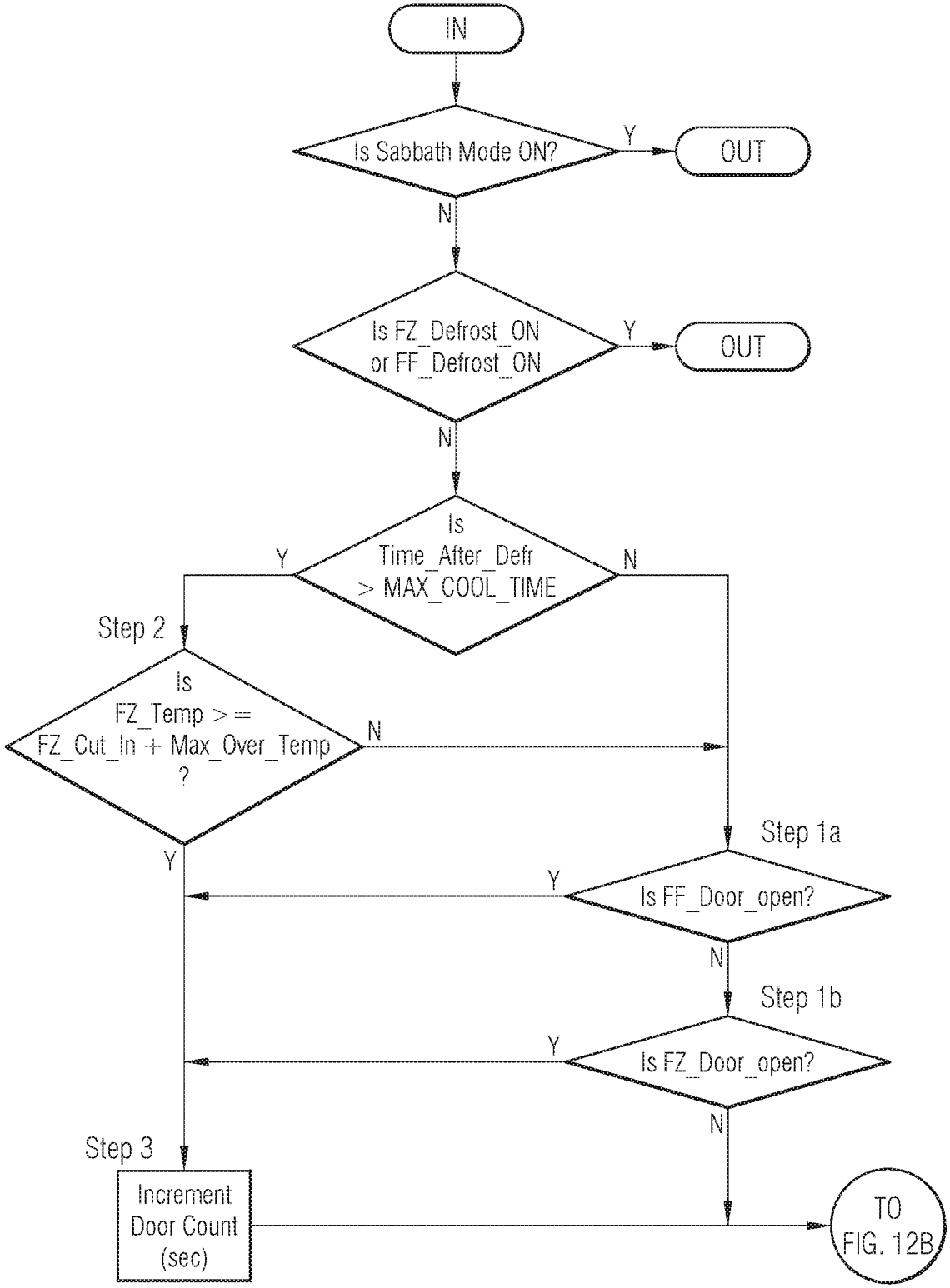
FIG. 12A is a flowchart illustrating a defrost interval reduction based on door openings.
Figure 12B:
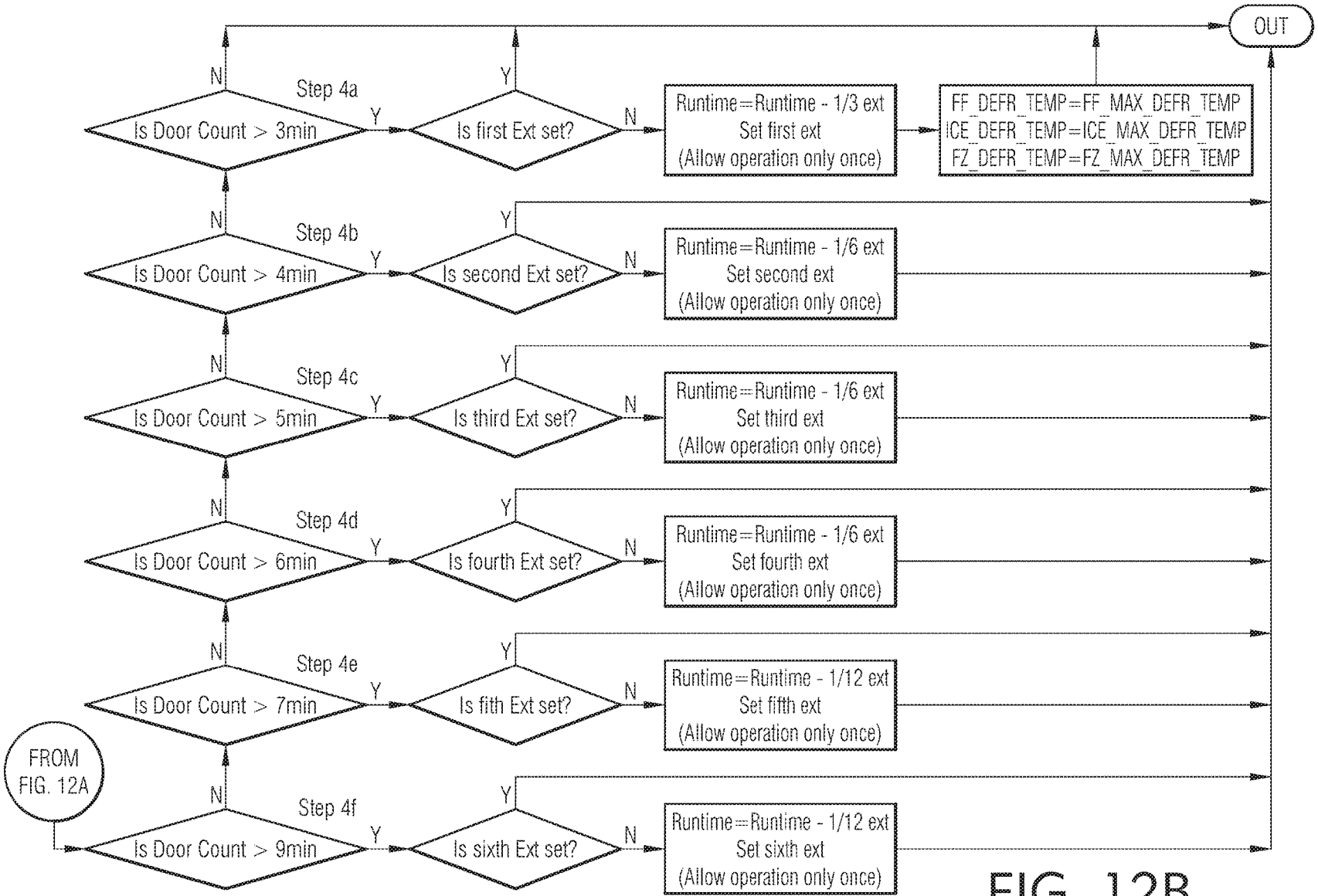
FIG. 12B is a flowchart illustrating the defrost interval reduction based on door openings.

Referring to FIG. 12, every time one of the doors of the refrigeration compartments is open, a door counter starts counting the time period the respective door remains open and the controller 42 reduces the defrost interval for every second the door remains open. The door counter may be a part of the controller 42. If the time after defrost is shorter than one hour (e.g., the maximum compressor pull down time MAX_COOL_TIME), in Steps 1*a* and 1*b*, the controller 42 monitors the door opening times of the doors of the fresh food compartment 52 and the freezer compartment 100, respectively. If the time after defrost is longer than one hour (e.g., the maximum compressor pull down time MAX_COOL_TIME), in Step 2, the controller 42 monitors whether the freezer compartment 100 temperature FZ_Temp is above the freezer compartment 100 user-selected set point temperature FZ_Cut_In+Max_Over_Temp (which can be an indirect measure of door openings). In Step 3, a door counter is incremented in both situations (e.g., one of the doors of the fresh food compartment 52 and the freezer compartment 100 is open, or the freezer compartment 100 temperature FZ_Temp is above the freezer compartment 100 user-selected set point temperature FZ_Cut_In+Max_Over_Temp). Next, in Steps 4*a*-4*f*, if a door remains open longer than 3, 4, 5, 6, 7, or 9 minutes, respectively, the defrost interval is reduced by a certain period of time from the table of values (described above) corresponding to the duration of time the door remains open. For example, if the door remains open between 3 minutes and 4 minutes, the defrost interval is reduced from the maximum defrost interval of 96 hours to 68 hours using the formula: 96−⅓*(96−12)=68 hours. If the door remains open between 4 minutes and 5 minutes, the defrost interval is reduced to 54 hours according to the formula: 68−⅙*(96−12)=54. If the door remains open for longer than 9 minutes, the defrost interval is reduced to 40 hours according to the formula: 54−⅙*(9−12)=40 and so on.

After the calculation of the reduced defrost interval based on the defrost length DEFR_Length (described above with reference to FIG. 11) and the reduced defrost interval based on the door openings (described above with reference to FIG. 12), the controller 42 compares the reduced defrost interval based on the defrost length DEFR_Length and the reduced defrost interval based on the door openings, and selects the shorter from these two reduced defrost intervals to be used as a default defrost interval DEFR_interval_0 for the next defrost cycle of each evaporator.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

The invention claimed is:

1. A refrigeration appliance, comprising:

a fresh food compartment for storing food items at a first target temperature above zero degrees Celsius;

a freezer compartment for storing food items at a second target temperature below zero degrees Celsius;

an ice maker disposed within the fresh food compartment for freezing water into ice pieces;

a refrigeration circuit having a compressor, a fresh food evaporator associated with the fresh food compartment, a freezer evaporator associated with the freezer compartment, and an ice maker evaporator associated with the ice maker; a fresh food evaporator fan, a freezer evaporator fan, and an ice maker evaporator fan, each located at the fresh food evaporator, the freezer evaporator, and the ice maker evaporator, respectively; a freezer defrost heater associated with the freezer evaporator and an ice maker defrost heater associated with the ice maker; and a valve connected to selectively direct refrigerant to flow to the fresh food evaporator, the freezer evaporator, and the ice maker evaporator in a first position and direct refrigerant to bypass the fresh food evaporator and flow to the ice maker evaporator and the freezer evaporator in a second position; and a controller operatively connected to the refrigeration circuit and programmed to control:

running the fresh food evaporator fan for a predetermined operating time, while the compressor is turned on and the valve is in the second position;

starting a defrost procedure including turning off the compressor, running the fresh food evaporator fan and the freezer evaporator fan while the freezer defrost heater is turned off;

after the freezer evaporator fan has been running for a predetermined freezer fan defrost time, turning off the freezer evaporator fan, turning on the freezer defrost heater, and running the freezer defrost heater until reaching a predetermined maximum freezer evaporator defrost temperature or until reaching a predetermined maximum run time for the freezer defrost heater;

turning on the ice maker defrost heater and running the ice maker defrost heater until reaching a predetermined maximum ice maker evaporator defrost temperature or until reaching a predetermined maximum run time for the freezer defrost heater;

turning off the freezer defrost heater and the ice maker defrost heater when reaching the respective predetermined maximum defrost temperature or when reaching the predetermined maximum run time for the freezer defrost heater;

ending the defrost procedure when both the freezer defrost heater and the ice maker defrost heater are turned off;

determining a defrost interval based on running times of the freezer defrost heater and the ice maker defrost heater so that the duration of the defrost interval is inversely related to the duration of the running time of the freezer defrost heater and the ice maker defrost heater, wherein the defrost interval is a time period between an end of a previous defrost cycle and a start of a next defrost cycle.

2. The refrigeration appliance of claim 1, wherein the controller is further programmed to:

upon determining that a specified interval since a last defrost procedure has expired and the valve is in an ice maker/freezer position, check a temperature of the fresh food compartment;

upon determining that the temperature of the fresh food compartment is equal to or above a user-selected set point temperature, start the defrost procedure for the fresh food evaporator, the freezer evaporator, and the ice maker evaporator;

upon determining that the temperature of the fresh food compartment is not equal to or above the user-selected set point temperature, delay a start of the defrost procedure for the fresh food evaporator, the freezer evaporator, and the ice maker evaporator until a specified boost time has expired; and upon determining that the valve is in a fresh food compartment position, delay the start of the defrost procedure for the fresh food evaporator, the freezer evaporator, and the ice maker evaporator until the specified boost time has expired.

3. The refrigeration appliance of claim 1, wherein the predetermined maximum freezer evaporator defrost temperature is sensed by a freezer evaporator temperature sensor and the predetermined maximum ice maker evaporator defrost temperature is sensed by an ice maker evaporator temperature sensor.

4. The refrigeration appliance of claim 1, wherein the controller is further programmed to end the defrost procedure after maximum predetermined drip times for the freezer evaporator, and the ice maker evaporator, respectively.

5. The refrigeration appliance of claim 1, wherein, after ending the defrost procedure, the controller is further programmed to delay turning on the compressor after both the freezer defrost heater and the ice maker defrost heater are turned off for maximum predetermined drip times for the freezer evaporator, and the ice maker evaporator, respectively.

6. The refrigeration appliance of claim 1, wherein the defrost procedure includes starting defrosting of the fresh food evaporator, the freezer evaporator, and the ice maker evaporator at the same time.

7. The refrigeration appliance of claim 6, wherein the starting of the defrost procedure comprises:

turning on the freezer evaporator fan, turning on the fresh food evaporator fan, and turning on the ice maker defrost heater.

8. The refrigeration appliance of claim 1, wherein the controller is further programmed to:

compare the heater activation periods of time for the ice maker defrost heater and the freezer defrost heater;

select a longer heater activation period of time between the heater activation periods of time for the ice maker defrost heater and the freezer defrost heater;

store the longer heater activation period as a defrost length; and calculate a new defrost interval based on the longer heater activation period stored as a defrost length.

9. The refrigeration appliance of claim 1, wherein, during the defrost procedure, the fresh food evaporator fan and the freezer evaporator fan run simultaneously.

10. A method for controlling defrost cycles of a first evaporator associated with a first refrigeration compartment and a second evaporator associated with a second refrigeration compartment of a refrigerator cooled by a refrigeration circuit having a compressor, a first defrost heater associated with the first evaporator, and a second defrost heater associated with the second evaporator, the method comprising the stcps of:

turning on the first defrost heater and the second defrost heater after a defrost interval has elapsed;

running the first defrost heater until reaching a predetermined maximum defrost temperature for the first refrigeration compartment or until reaching a predetermined maximum run time for the first defrost heater;

running the second defrost heater until reaching a predetermined maximum defrost temperature for the second refrigeration compartment or until reaching a predetermined maximum run time for the second defrost heater;

counting, with a timer, heater activation periods of time during which the first defrost heater and the second defrost heater have been on;

comparing the heater activation periods of time for the first defrost heater and the second defrost heater;

selecting a longer heater activation period of time between the heater activation periods of time for the first defrost heater and the second defrost heater;

storing the longer heater activation period as a defrost length; and calculating a new defrost interval based on the defrost length.

11. The method according to claim 10, wherein the defrost interval is a time period between an end of a previous defrost cycle and a start of a next defrost cycle.

12. The method according to claim 10, wherein the first refrigeration compartment is a freezer compartment for storing items at a target temperature below zero degrees Celsius.

13. The method according to claim 10, wherein the refrigeration circuit comprises a condenser fan, a first evaporator fan, and a second evaporator fan located in a vicinity of the first evaporator and the second evaporator, respectively.

14. The method according to claim 13, further comprising:

activating at least one of the first evaporator fan and the second evaporator fan, while the compressor, the condenser fan, and the defrost heaters are all turned off;

running the at least one of the first evaporator fan and the second evaporator fan for a predetermined fan defrost time for each of the first evaporator fan and the second evaporator fan;

after the at least one of the first evaporator fan and the second evaporator fan has been running for the predetermined time, turning the at least one of the first evaporator fan and the second evaporator fan off, turning the respective first defrost heater or second defrost heater on, and starting the timer to count the heater activation period of time during which each defrost heater has been on; and when either a defrost cut-off temperature in at least one of the first refrigeration compartment and the second refrigeration compartment, or a maximum predetermined heater activation period of time for each defrost heater has been reached, turning off the respective first defrost heater or second defrost heater, and storing the heater activation period of time for each defrost heater in a memory.

15. The method according to claim 10, wherein a length of the defrost interval is selected from a table of values corresponding to times doors of at least one of the fresh-food compartment and the freezer compartment are opened and durations of time the doors remain open.

16. The method according to claim 15, further comprising:

every time at least one of the doors of at least one of the first refrigeration compartment and the second refrigeration compartment is open, counting, by a door counter, a time period the respective door remains open;

reducing the defrost interval for every second the respective door remains open; and storing the reduced defrost interval.

17. The method according to claim 16, further comprising:

comparing the defrost length with the reduced defrost interval;

selecting a shorter one of the defrost length and the reduced defrost interval as the new defrost interval.

18. A refrigeration appliance, comprising:

a first refrigeration compartment;

a second refrigeration compartment;

a refrigeration circuit having a compressor, a first evaporator associated with the first refrigeration compartment, a second evaporator associated with the second refrigeration compartment; and a first defrost heater associated with the first evaporator and a second defrost heater associated with the second evaporator; and a controller operatively connected to the refrigeration circuit and programmed to:

turn on the first defrost heater and the second defrost heater after a defrost interval has elapsed;

run the first defrost heater until reaching a predetermined maximum defrost temperature for the first refrigeration compartment or until reaching a predetermined maximum run time for the first defrost heater;

run the second defrost heater until reaching a predetermined maximum defrost temperature for the second refrigeration compartment or until reaching a predetermined maximum run time for the second defrost heater;

count heater activation periods of time during which the first defrost heater and the second defrost heater have been on;

compare the heater activation periods of time for the first defrost heater and the second defrost heater;

select a longer heater activation period of time between the heater activation periods of time for the first defrost heater and the second defrost heater;

store the longer heater activation period as a defrost length; and calculate a new defrost interval based on the defrost length.

19. The refrigeration appliance of claim 18, wherein the controller comprises a timer that counts the predetermined maximum run time for the first defrost heater, the predetermined maximum run time for the second defrost heater, and the heater activation periods of time during which the first defrost heater and the second defrost heater have been on.

20. The refrigeration appliance of claim 18, further comprising a plurality of temperature sensors that sense temperatures of the first evaporator and the second evaporator, and generate temperature signals based on the sensed temperatures, wherein the controller receives the temperature signals from the temperature sensors, determines whether the temperatures of the first evaporator and the second evaporator are lower than a predetermined maximum evaporator temperature for each evaporator, and generates control signals setting the defrost interval based on a determination result.

21. The refrigeration appliance of claim 18, further comprising a memory that stores program instructions executed by the controller; default defrost intervals; predetermined defrost cut-off temperatures for each of the first refrigeration compartment and the second refrigeration compartment; a maximum time for running each of the first defrost heater and the second defrost heater; the heater activation period of time during which each of the first defrost heater and the second defrost heater has been on; a table of values corresponding to times between openings of doors of the first refrigeration compartment and the second refrigeration compartment, and durations of time the doors remain open.

22. The refrigeration appliance of claim 18, wherein the refrigeration circuit comprises a condenser fan, a first evaporator fan, and a second evaporator fan located in a vicinity of the first evaporator and the second evaporator, respectively, wherein the controller is further programmed to:

activate at least one of the first evaporator fan and the second evaporator fan, while the compressor, the condenser fan, and the defrost heaters are all turned off;

run the at least one of the first evaporator fan and the second evaporator fan for a predetermined fan defrost time for each of the first evaporator fan and the second evaporator fan;

after the at least one of the first evaporator fan and the second evaporator fan has been running for the predetermined time, turn the at least one of the first evaporator fan and the second evaporator fan off, turn the respective first defrost heater or second defrost heater on, and start the timer to count the heater activation period of time during which each defrost heater has been on; and when either a defrost cut-off temperature in at least one of the first refrigeration compartment and the second refrigeration compartment, or a maximum predetermined heater activation period of time for each defrost heater has been reached, turn off the respective first defrost heater or second defrost heater, and store the heater activation period of time for each defrost heater in a memory.

23. The refrigeration appliance of claim 18, wherein:

the second refrigeration compartment is an ice-making compartment; and the second evaporator is a remote part of the first evaporator.

24. The refrigeration appliance of claim 18, wherein:

the first refrigeration compartment is a freezer compartment for storing items at a target temperature below zero degrees Celsius; and the second refrigeration compartment comprises an ice-making compartment with the second evaporator associated with the ice-making compartment.

* * * * *